United States Patent [19]

Miura et al.

[11] Patent Number: 4,865,961

[45] Date of Patent: Sep. 12, 1989

[54] SILVER HALIDE COLOR PHOTOGRAPHIC LIGHT-SENSITIVE MATERIAL

[75] Inventors: Norio Miura, Kokubunji; Shuji Kida, Hino; Satoshi Nakagawa, Sagamihara; Toshihiko Kimura, Hamura, all of Japan

[73] Assignee: Konica Corporation, Tokyo, Japan

[21] Appl. No.: 158,715

[22] Filed: Feb. 22, 1988

[30] Foreign Application Priority Data

Feb. 23, 1987 [JP] Japan ..... 62-39565

[51] Int. Cl.[4] ..... G03C 7/34

[52] U.S. Cl. ..... 430/553; 430/385

[58] Field of Search ..... 430/553, 385

[56] References Cited

FOREIGN PATENT DOCUMENTS 106306 4/1984 European Pat. Off. .
148536 7/1985 European Pat. Off. .
175573 3/1986 European Pat. Off. .
201027 11/1986 European Pat. Off. .

*Primary Examiner*—Paul R. Michl
*Assistant Examiner*—Lee C. Wright
*Attorney, Agent, or Firm*—Finnegan, Henderson, Farabow, Garrett, & Dunner

[57] ABSTRACT

A silver halide color photographic light-sensitive material comprising a silver halide emulsion layer containing a cyan coupler represented by the following general formula [I]. The color photographic material is improved in sensitivity, density of cyan image, density losing of cyan image due to processing by a fatigued bleach or bleach-fix solution.

General formula [I]

6 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, in particular, to a silver halide color photographic light-sensitive material capable of providing a cyan dye image indicating satisfactory spectral absroption property and free from dye loss, even if treated with a bleaching bath or bleach-fixing bath which has been fatigued in the course of running treatment.

BACKGROUND OF THE INVENTION

With a silver halide color photographic light-sensitive material, a dye image is usually formed in the following manner: first, silver halide particles, which underwent exposing, are reduced by an aromatic primary amine color developing agent; next, the resultant oxidation product of the color developing agent couples with couplers respectively forming yellow, magenta, and cyan dyes.

Couplers widely used for forming the cyan dye are phenol cyan couplers and naphthol cyan couplers.

The recent photographic industry witnessed a phenomenon resulting from the rapid progress in color photography has prompted a drastic increase in the amount of color negative films being treated, where the bleaching bath or bleach-fixing bath readily develops fatigue in the course of running treatment.

It was found that a naphthol compound conventionally widely used as a cyan coupler for a color negative film has a disadvantage; when such a film is treated with a fatigued bleaching bath or bleach-fixing bath, a cyan dye once formed reverts to a leuco matter, resulting in dye loss. To solve these problems, cyan couplers having a phenylureide group in the 2-position on a phenol was developed as described in Japanese Patent Open to Public Inspection (hereinafter referred to a Japanese Patent O.P.I. Publication) Nos. 21139/1972, 65134/1981, 204543/1982, 204544/1982, 204545/1982, 98731/1983, 187928/1983 and the like. This cyan coupler drastically improved the dye loss. However, these cyan couplers have a disadvantage regarding color reproduction; in relation to spectral absorption property, the dyes formed from these couplers, when compared with dyes formed from naphthol couplers, have a maximum absorption wavelength in a relatively shortwave range, hence greater absorption in the green range to a shortwave range. Human vision is especially sensitive to a green light. Therefore, even marginal reduction in green absorption contributes to greater improve in color reproduction as appreciated by human vision. This is because further improved cyan couplers are required.

SUMMARY OF THE INVENTION

The first object of the present invention is to provide a highly sensitive, silver halide color photographic light-sensitive material being capable of forming a cyan image with high color density.

The second object of the invention is to provide a silver halide color photographic light-sensitive material being capable of forming a cyan image free from dye loss even when using a bleaching bath or bleach-fixing bath fatigued in the course of running treatment.

The third object of the invention is to provide a silver halide color photographic light-sensitive material being capable of forming a cyan dye image which has a satisfactory spectral absorption property and of which maximum absorption range is in a comparatively longer wavelength side.

The fourth object of the invention is to provide a silver halide color photographic light-sensitive material being capable of forming a cyan dye image and manufactured at a relatively low cost.

The fifth object of the invention is to provide a silver halide color photographic light-sensitive material excelling in dispersion stability and capable of forming a cyan image.

These objects of the invention are attained by a silver halide color photographic light-sensitive material comprising a silver halide emulsion layer containing a cyan coupler represented by the following general formula I:

General formula [I]

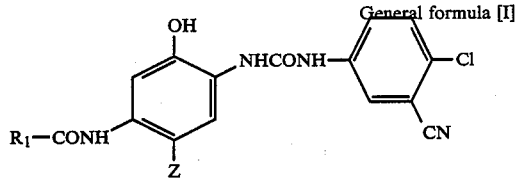

(wherein $R_1$ represents a substituted or not substituted alkyl or a substituted or not-substituted aryl group, and Z represents a group represented by the following formula [II], [III], [IV] or [V])

General formula [II]

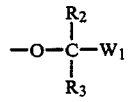

General formula [III]

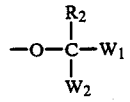

$-OCOR_4$ General formula [IV]

$-OSO_2R_5$ General formula [V]

(wherein $R_2$, $R_3$ and $R_5$ independently represent a hydrogen atom, a substituted or not substituted alkyl group, or substituted or not substituted aryl group, $R_2$ and $R_3$ may be the same or different from each other; $W_1$ represents a group having a $\sigma p$ value of Hammet's rule of not less than 0.4, $W_4$ represents a group having a $\sigma p$ value of Hammet's rule of not less than O, $W_1$ and $W_2$ may be the same or different from each other; $R_4$ represents an alkyl group, an aryl group, an alkoxy group, an aryloxy group, an alkylamino group or aryl amino group, which may be subsituted or not substituted.)

$R_1$ in general formula [I] represents an alkyl or aryl group. The specific alkyl group is an alkyl group having 1 to 20 carbon atoms, and such an alkyl group may have a substituent. The preferred alkyl group is a group represented by the following general formula [VI].

General formula [VI]

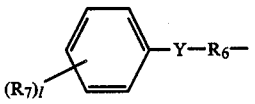

(wherein Y represents —O—, —S—, or —$SO_2$—; $R_6$ represents an alkylene group with 1 to 20 carbon atoms (such as a methylene, 1,1-ethylene, 1,1-propylene, 1,3-propylene, 2-methyl-1,1-propylene, 1,1-pentylene, 1,1-heptylene, 1,1-nonylene, 1,1-undecylene, 1,1-tridecylene, or 1,1-pentadecylene group); $R_7$ represents a halogen atom (such as a chlorine or fluorine atom); or a hydroxy group, or an alkyl group with 1 to 20 carbon atoms (such as a methyl, ethyl, tert-butyl, tert-pentyl, cyclopentyl, tert-octyl, or pentadecyl group); or an alkoxy group (such as a methoxy, ethoxy, isopropoxy, butoxy, hexyloxy, or dodecyloxy group); an alkylsulfonamido group (such as a methanesulfonamido, ethanesulfonamido, butanesulfonamido, octylsulfonamido, or hexadecylsulfonamido group), or an arylsulfonamido group (such as a benzenesulfonamido, m-chlorobenzenesulfonamido, toluenesulfonamido, p-methoxybenzenesulfonamido, or p-dodecyloxybenzenesulfonamido group); or an alkylsulfamoyl group (such as a butylsulfamoyl, tert-butylsulfamoyl, or dodecylsulfamoyl group); or an arylsulfamoyl group (such as a benzenesulfamoyl, toluenesulfamoyl, or dedecyloxybenzenesulfamoyl group); or an alkylsulfonyl group (such as a methanesulfonyl, or butanesulfonyl group); or an arylsulfonyl group (such as a benzenesulfonyl, p-benzyloxyphenylsulfonyl, or p-hydroxyphenylsulfonyl group); or an alkoxycarbonyl group (such as an ethoxycarbonyl, butoxycarbonyl, or hexadecyloxycarbonyl group); l represent an integer 1 to 4, preferably, 1 or 2; when l is greater than 2, $R_7S$ may be identical or different with each other.)

According to the invention, a preferred aryl group represented by $R_1$ in general formula [I] is a phenyl group, wherein the phenyl group may have a substituent which is represented by $R_7$ in general formula [VI]

$R_2$, $R_3$ and $R_5$ in general formulas [II] through [V] independently represent a hydrogen atom, or an alkyl group (for example, an alkyl or alkenyl group with 1 to 18 carbon atoms, or an aryl group, (for example an aralkyl or aralkenyl group; or an aryl group with 6 to 12 carbon atoms). The alkyl group, alkenyl group, aralkyl group, aralkenyl group or aryl group represented any of $R_2$, $R_3$ and $R_5$ may have a such a substituent as a halogen atom such as fluorine, chlorine, or bromine atom, nitro group, cyano group, hydroxy group, alkoxy group, acyloxy group, acylamino group, sulfonamido group, sulfamoyl group, sulfonyl group, carboxy group or sulfo group, or another group. Additionally, the alkyl group, alkenyl group, aralkyl group, or aralkenyl group represented any of $R_2$, $R_3$ and $R_5$ may be either straight-chained or branched.

$W_1$ represents a group of which $\sigma p$ value according to Hammett's is greater than 0.4. The examples of such a group include a trifluoromethyl group, cyano group, formyl group, acyl group ($COR_8$), alkoxycarbonyl group, aryloxycarbonyl group (—$COOR_8$), sulfonyl group (—$SO_2R_8$), and sulfamoyl group

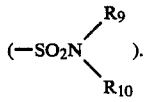

What are represented by $R_8$, $R_9$ and $R_{10}$ are respectively identical with those the previously defined with $R_2$, $R_3$ and $R_5$. $W_2$ represents a group of which $\sigma p$ value according to Hammett's rule is 0 is larger (for example, 0.0). The examples of such a group include a halogen atom, (F, Cl, Br, and I), a trifluoromethyl group, a cyano group, or a substituted or unsubstituted group of carbamoyl group,

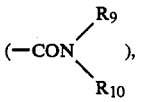

formyl, acyl, alkoxycarbonyl, arylxycarbonyl, sulfonyl and sulfamoyl. $R_4$ represents an alkyl group, aryl group, alkoxy group, aryloxy group, alkylamino group or arylamino group. Among these groups, the alkyl and aryl portions are identical with those previously defined for $R_2$, $R_3$ and $R_5$.

The typical examples of the cyan coupler of the invention are listed below. However, the scope of the invention is not limited only to these examples. Me represents $CH_3$.

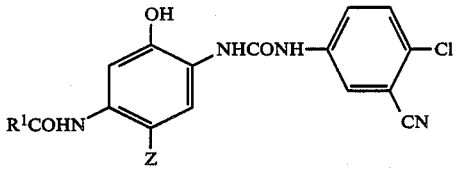

| Coupler No. | $R_1$ | Z |
|---|---|---|
| 1 | 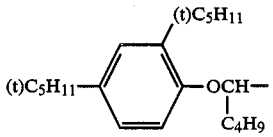 | $OCH_2CO_2CH_3$ |

-continued
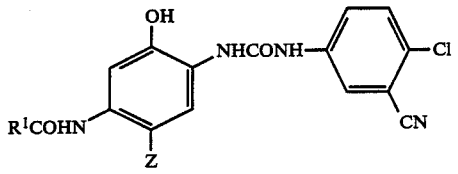
| Coupler No. | $R_1$ | Z |
|---|---|---|
| 2 | 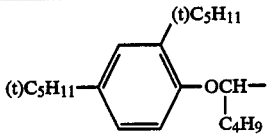 | $OCH_2COCH_3$ |
| 3 | 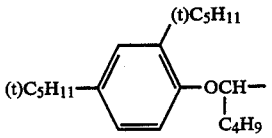 | $OCH_2CN$ |
| 4 | 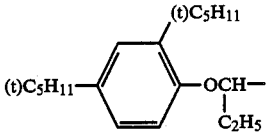 | $OCH_2CF_3$ |
| 5 | 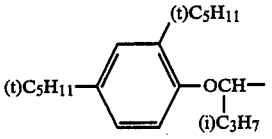 | 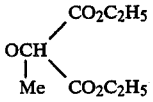 |
| 6 | 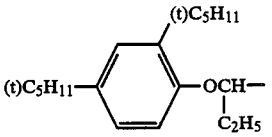 | 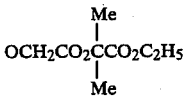 |
| 7 | 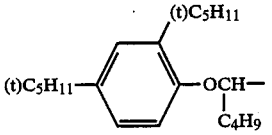 | 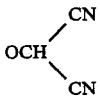 |
| 8 | 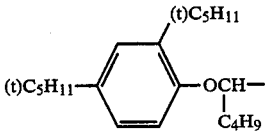 | $OCOOCH_3$ |
| 9 | 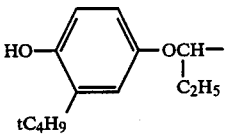 | 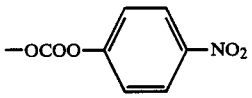 |
| 10 | 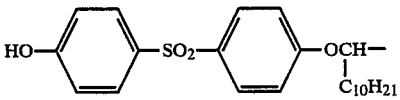 | 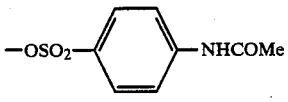 |
| 11 | 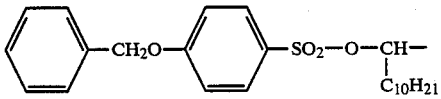 | $-OSO_2C_2H_5$ |

-continued
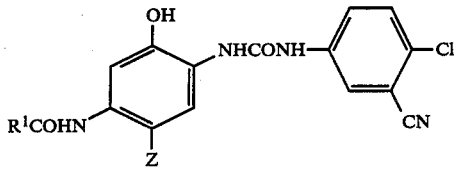
| Coupler No. | $R_1$ | Z |
|---|---|---|
| 12 | 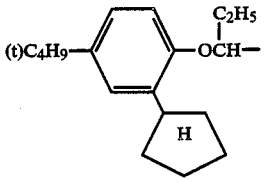 | $-OCONHC_{12}H_{25}$ |
| 13 | 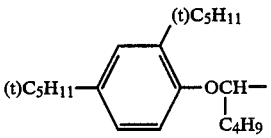 | 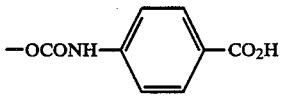 |
| 14 | 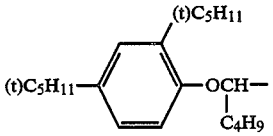 | $-OCH_2SO_2NHCH_3$ |
| 15 | 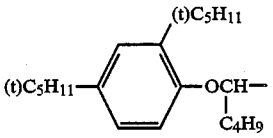 | $-OCH_2NO_2$ |
| 16 | 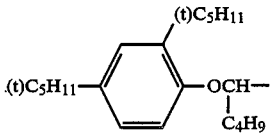 | 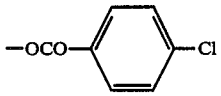 |
| 17 | 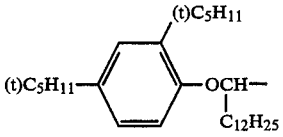 | 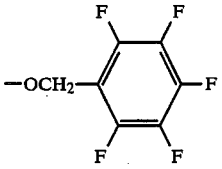 |
| 18 | 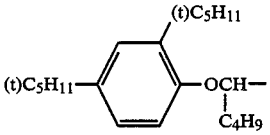 | $-OCOCH_2CH_2Cl$ |
| 19 | 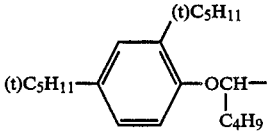 | 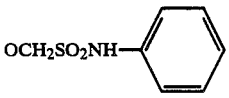 |
| 20 | 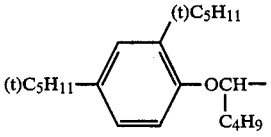 | 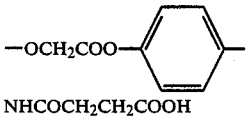 |

-continued
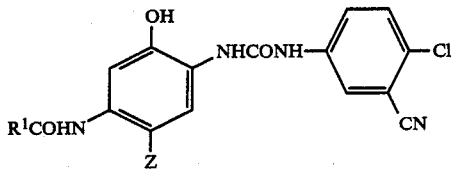
| Coupler No. | $R_1$ | Z |
|---|---|---|
| 21 | 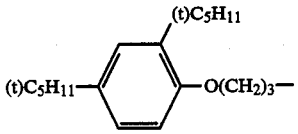 | 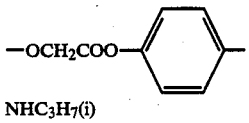 |
| 22 | 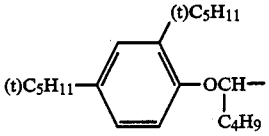 | $-OCH_2CO_2CH_2CO_2CH_3$ |
| 23 | 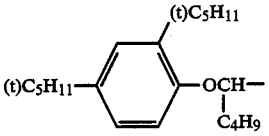 | $-OCH_2CO_2CH_2CH_2OH$ |
| 24 | 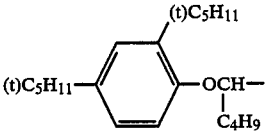 | $-OCH_2COOCH_3$ (C6H13) |
| 25 | 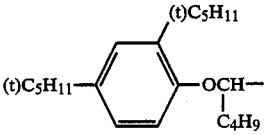 | $-OCHCOOCH_3$ ($CH_3$) |
| 26 | 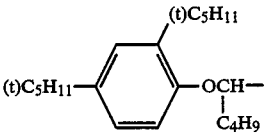 | $-OCH_2COOH$ |
| 27 | 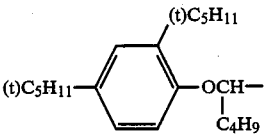 | $-OCH_2COOCH_2SO_2NHC_4H_9$ |
| 28 | 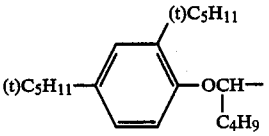 | $-OCH_2COOC(CH_3)_3$ |
| 29 | 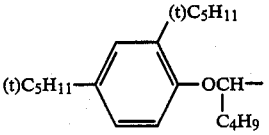 | $-OCH_2COOC_6H_{13}$ |

-continued
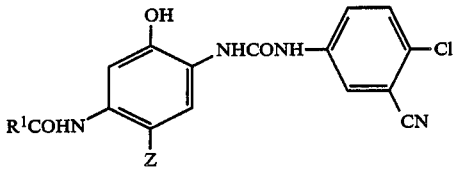
| Coupler No. | $R_1$ | Z |
|---|---|---|
| 30 | 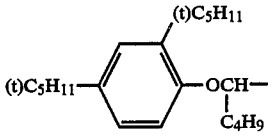 | $-OCH_2COOCH_2(CF_2CF_2)_2H$ |
| 31 | 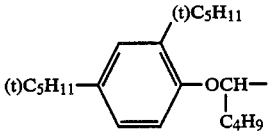 | $-OCH_2COOCH(C_6H_{13})COOH$ |
| 32 | 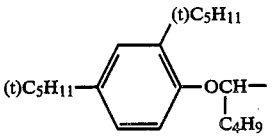 | $-OCH_2COOC_2H_5$ |
| 33 | 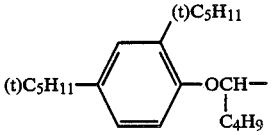 | $-OCH_2COOCH_2-$ 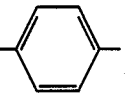 |
| 34 | 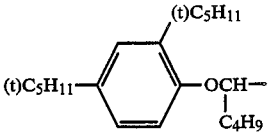 | $-OCH_2COOCH_2CH_2SCH(COOH)C_{12}H_2$ |
| 35 | 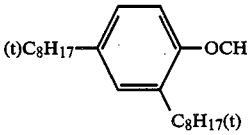 | $-OCH_2COOCH_2CH_2OCH_2CH_2O-$ 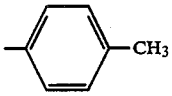 |
| 36 | 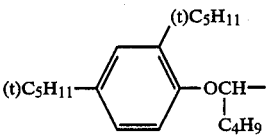 | $-OCH_2COOCH_2CH_2OCH_2CH_2OCH_3$ |
| 37 | 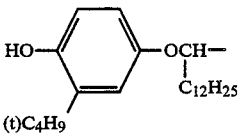 | $-OCH_2COO(CH_2CH_2O)_4C_4H_9(t)$ |
| 38 | 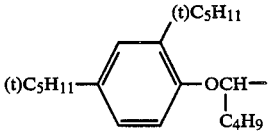 | $-OCH_2COOCH_2CH_2OCH_2CH_2OC_6H_{13}$ |
Tye cyan coupler of the invention is readily synthesized according to the following procedure.
Synthetic scheme

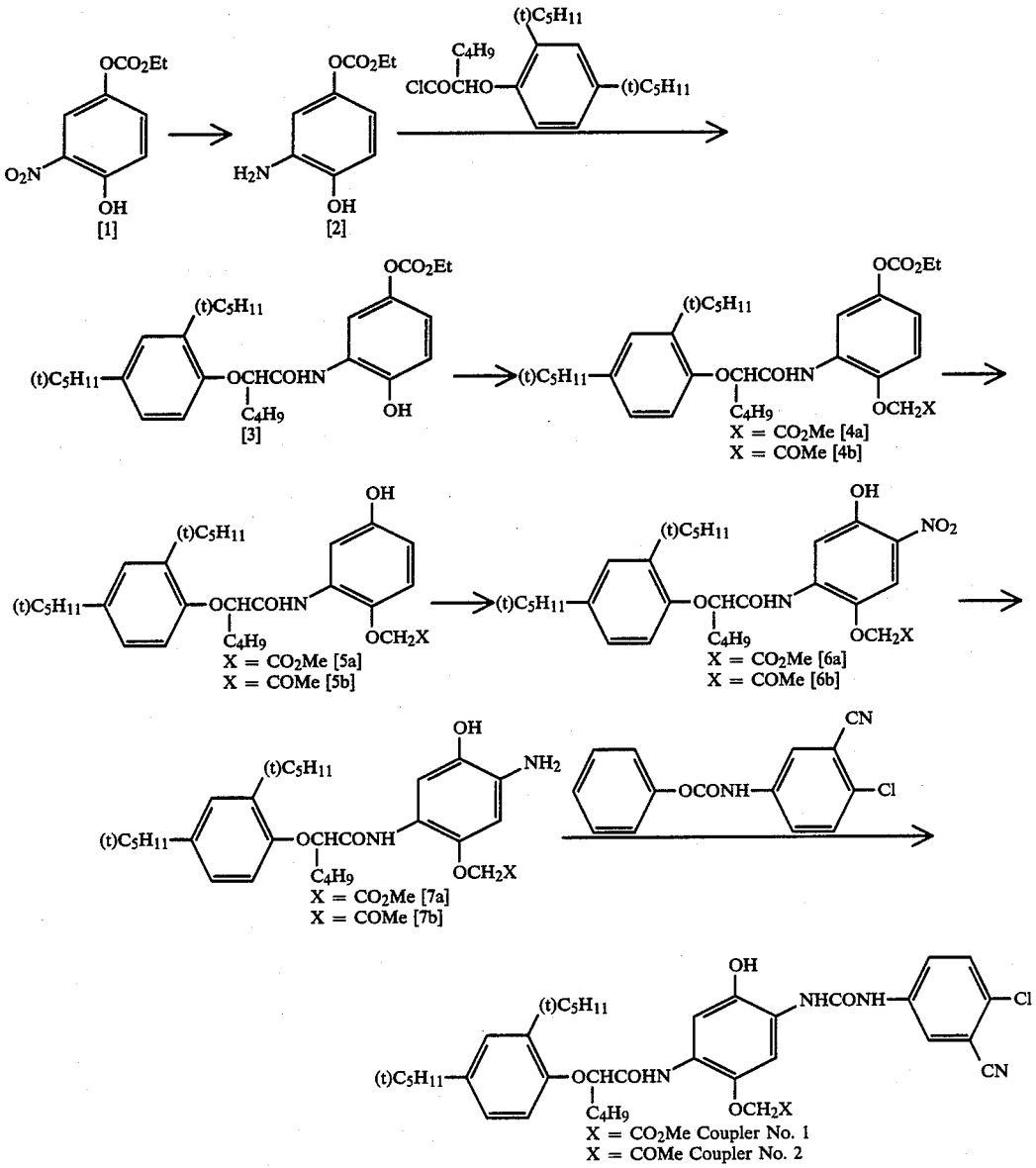

Synthesis example-1 (synthesis of coupler No. 1)

5.0 g of compound [1] synthesized according to the procedure described in Japanese Patent Publication No. 45142/1974 was dissolved in 50 ml of methanol, into which 1.0 g of Raney nickel, whereby the mixture was subjected to catalytic hydrogenation under the conditions of a normal temperature and normal pressure.

Once the reaction was complete, the catalyst was removed by filtration, and then the solvent was distilled away, whereby the residue was rinsed with a mixture solvent of ethyl acetate and n-hexane. As a result, 3.7 g of compound [2] in the form of crude crystals (yield, 85%) was abtained. The compound was dissolved in 40 ml of ethyl acetate, into which 2.5 of N,N-dimethylaniline was added, whereby ethyl acetate solution (20 ml) containing 7.6 g of 2-(2,4-di-tert-amylphenoxy)hexanoylchloride was added dropwise into the solution at a room temperature. The solution was subjected to stirring for five hours. To the reaction solution was added 50 ml of ethyl acetate, and the solution was rinsed with water and condensed under reduced pressure, whereby the residue was recrystallized using a mixture solvent of ethyl acetate and n-hexane, resulting in 7.1 g (yield, 71%) of compound [3]. The melting point, mp, of this compound is 108° to 110° C. This compound was dissolved in 100 ml of acetone, to which 2.1 g of potassium carbonate and 3.1 g of ethyl bromoacetate were added, thereby the solution was refluxed for two hours by heating. Once the reaction was complete, insoluble matters were filtered out, and the solution was condensed under reduced pressure. Ethyl acetate was added to the residue, which was rinsed with water, and then the solvent was distilled away, thus 7.3 g (yield, 90%) of compound [4a] in the form of oil was obtained.

20.6 g of compound [4a] was dissolved in 200 ml of methanol, to which a solution (20 ml) containing 2.7 g of sodium hydroxide was added. The mixture solution was stirred for one hour at a room temperature. Once the reaction was complete, the reaction solution was condensed under reduced pressure, and to which water was added, and made acid with hydrochloric acid, thereby extraction was performed using ethyl acetate. After rinsing with water, solvent was distilled away, thereby 100 ml of methanol and one or two droplets of condentrated sulfuric acid was added to the residue, which was refluxed by heating for four hours.

Once the reaction was complete, the resultant solution was condensed under reduced pressure, thereby the residue was recrystallized with n-hexane, thus providing 15.5 g (yield, 86%) of compound [5a]. The mp of this compound is 128° to 130° C. 5.3 g of compound [5a] was dissolved in 30 ml of chloroform, whereby 1.1 ml of concentrated nitric acid (d=1.38) was added dropwise to the chloroform solution cooled by ice water, and then the solution was stirred for 30 minutes. Once the reaction was complete, the reaction product was rinsed with water and condensed under reduced pressure. Then, the residue was purified by means of silica gel column chromatography. As a result, 5.0 g (yield, 87%) of compound [6a] in the form of oil was obtained. This compound was dissolved in 150 ml of methanol, thereby the solution was subjected to catalytic hydrogenation using palladium catalyst supported on carbon carrier under the conditions of a normal temperature and normal pressure.

Once the reaction was complete, the catalyst was filtered out, and the remaining solution was condensed under reduced pressure, thereby to the residue were added 30 ml of acetonitrile, 20 mg of imidazole, and 2.0 g of phenyl 3-cyano-4-chlorophenylcarbamate, and the mixture was refluxed for two hours by heating. The reaction solution was cooled, thereby precipitated crystals were filtered off and recrystallized with acetonitrile. Thus, 3.4 g (yield, 53%) of coupler No. 1 was obtained. The mp of this coupler is 143° to 145° C. The structure of the coupler was identified by means of NMR, IR, and MASS techniques.

Synthesis example-2 (synthesis of coupler No. 2)

10 g of compound [3] was dissolved in 150 ml of acetone, to which 3.9 g of potassium cabonate and 2.6 g of chloracetone were added, whereby the solution was refluxed for three hours by heating. Once the reaction was complete, the insoluble matters were filtered out, and then the solution was condensed under reduced pressure, whereby to the residue was added 100 ml of methanol, to which were added aqueous solution (20 ml) containing 1.2 g of sodium hydroxide, and the solution was stirred for one hour at a room temperature. Once the reaction was complete, the solution was condensed under reduced pressure, and to which water was added, thereby the condensed solution was made acid with hydrochloric acid, and then extraction was performed using ethyl acetate. After rising with water, solvent was distilled away, thereby the residue was purified by means of silica gel column chromatography. As a result, 9.5 g (yield, 98%) of compound [5b] in the form of oil was obtained. This compound was dissolved in 100 ml of chloroform, to which 2.0 ml of condensed nitric acid (d=1.38) was added dropwise, thereby the solution was heated to 40° C. and stirred for 30 minutes. Once the reaction was complete, the resultant mixture was rinsed with water and condensed under reduced pressure, thereby the residue was purified by means of silica gel column chromatography. As a result, 5.4 g (yield, 52%) of compound [6b] in the form of oil was obtained. This compound was dissolved in 300 ml of methanol, thereby the solution was subjected to catalytic hydrogenation using palladium catalyst supported on carbon carrier under the conditions of a normal temperature and normal pressure. Once the reaction was complete, the catalyst was filtered out, and the remaining solution was condensed under reduced pressure, thereby to the residue were added 60 ml of acetonitrile, 30 mg of imidazole, and 3.2 g of phenyl 3-cyano-4-chlorophenylcarbamate, and the mixture was refluxed for two hours by heating. The reaction solution was cooled, thereby precipitated crystals were filtered off. And then, the crude crystals were heated and rinsed with a mixture solvent of ethyl acetate and n-hexane, and recrystallized with acetonitrile, thus 4.4 g (yield, 59%) of coupler No. 2 was prepared. This coupler has the mp of 164° to 166° C. The structure of the coupler was identified by means of NMR, IR, and MASS techniques.

A silver halide color photographic light-sensitive material prepared using any of the couplers according to the invention (hereinafter referred to as the couplers of the invention) specified above may contain a dye forming coupler which has been conventionally used in the art.

A cyan dye forming coupler used in embodying the invention may be used in compliance with a conventional method and purposes which are commonly observed when using a cyan dye forming coupler in photography.

Generally, the cyan coupler of the invention is contained in a silver halide emulsion layer and/or an adjacent non-light-sensitive layer. Typically, the cyan coupler of the invention is incorporated into a silver halide emulsion, whereby the emulsion is applied and dried onto a support, in order to prepare a silver halide color photographic light-sensitive material comprising a silver halide emulsion layer containing the cyan coupler. Such a silver halide color photographic light-sensitive material may be either fo a monochromatic or multi-color application. In a multi-color application, the cyan coupler of the invention is usually incorporated into a red-sensitive emulsion or non-sensitized emulsion. The cyan coupler may be contained in an emulsion layer that is sensitive to three primary color spectrums other than of red.

Each component for forming a dye image according to the invention comprises a single emulsion layer or multi-emulsion layer which is sensitive to a specific spectral band.

The layers, including the image forming component layer above, for composing a silver halide color photographic light-sensitive material may be arranged in various orders known in the photographic art. A typical multi-color silver halide color photographic light-sensitive material comprises a support, disposed thereon, a cyan dye-image forming component comprising at least one red-sensitive silver halide emulsion layer having at least one cyan dye forming coupler, in which at least one cyan coupler is the cyan coupler of the invention; a magenta dye-image forming component comprising at least one green-sensitive silver halide emulsion layer having at least one magenta dye forming coupler; and a yellow dye-image forming component comprising at least one blue-sensitive silver halide emulsion layer having at least one yellow dye forming coupler.

Such a photographic light-sensitive material may have additional layers, such as a filter layer, intermediate layer, and subbing layer.

When preparing a silver halide color photographic light-sensitive material by using the coupler of the invention, additional layers are necessary; they are a light-sensitive layer containing yellow dye forming coupler, and a light-sensitive layer containing magenta dye forming coupler.

The useful yellow dye forming couplers are those conventionally known in the art; for example, those represented by the following general formula [VII].

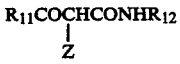

General formula [VII]

(wherein $R_{11}$ represents an alkyl or aryl group; $R_{12}$, an aryl group; Z, a hydrogen atom, or a group being capable of splitting off by reaction with an oxidation product of a color developing agent.)

The examples of Z in general formula [VII] are groups represented by the following general formula [VIII] or [IX].

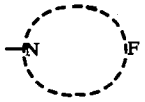

General formula [VIII]

(wherein F represents a group of non-metal atoms being capable of forming a five- or six-membered ring.)

General formula [IX]

(wherein $R_{13}$ represents an aryl group, and, preferably, a substituted phenyl group.)

The useful magenta dye forming couplers are those conventionally known in the art; for example, those represented by the following general formula [X], [XI] or [XII].

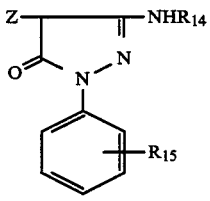

(wherein $R_{14}$ represents an alkylcarbonyl group, aryl carbonyl group, or aryl group; $R_{15}$, a monovalent group; Z, a hydrogen atom, or a group being capable of splitting off by reaction with an oxidation product of a color developing agent.)

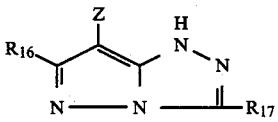

General formula [XI]

(wherein $R_{16}$ represents an alkyl group or aryl group; $R_{17}$, an alkyl group, aryl group, or alkylthio group; Z, a group being capable of splitting off by reaction with an oxidation product of a color developing agent.)

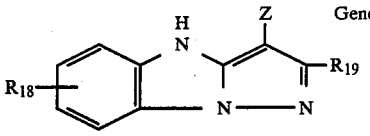

General formula [XII]

(wherein $R_{18}$ represents a monovalent group; $R_{19}$, an alkyl group, aryl group, acylamino group, or alkoxy group; Z, a hydrogen atom, or a group being capable of splitting off by reaction with an oxidation product of a color developing agent.)

The cyan dye forming coupler of the invention may be used together with another cyan dye forming coupler.

The useful cyan dye forming couplers are those conventionally known in the art; for example, those represented by the following general formula [XIII], or [XIV].

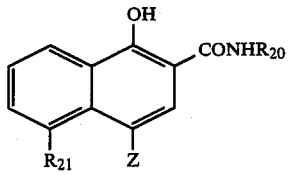

General formula [XIII]

(wherein $R_{20}$ represents an alkyl group or aryl group; $R_{21}$, an acylamino group, alkoxycarbonylamino group, sulfonamido group, or ureide group; Z, a hydrogen atom, or a group being capable of splitting off by reaction with an oxidation product of a color developing agent.)

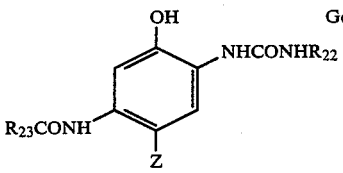

General formula [XIV]

(wherein $R_{22}$ represents an alkyl group; $R_{22}$, an aryl group; $R_{23}$, an alkyl group; Z, a hydrogen atom, or a group being capable of splitting off by reaction with an oxidation product of a color developing agent.)

The typical examples of yellow, magenta and cyan couplers represented respectively by general formulas [VII], [X], [XI], [XII] and [XIV] are the following compounds. However, the scope of the invention is not limited only to these examples. These couplers are arbitrarily selected in compliance with a requirement, and two or more couplers of a specific dye may be combinedly used.

(Y-1)
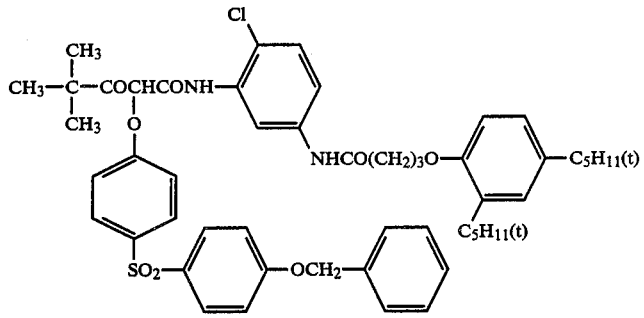
(Y-2)
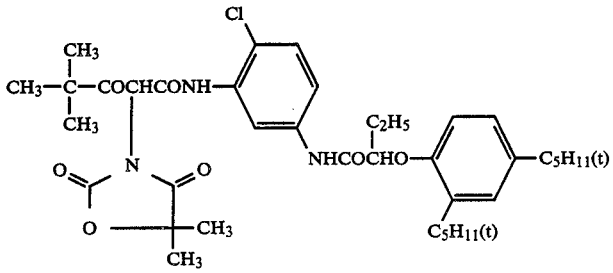
(Y-3)
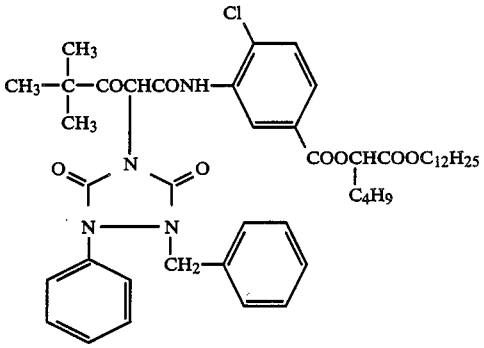
(Y-4)
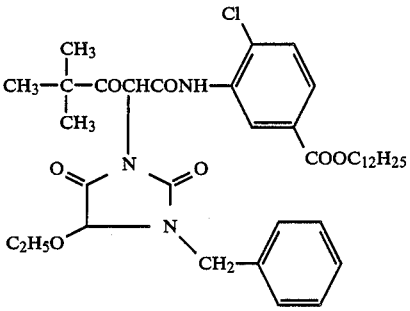
(Y-5)
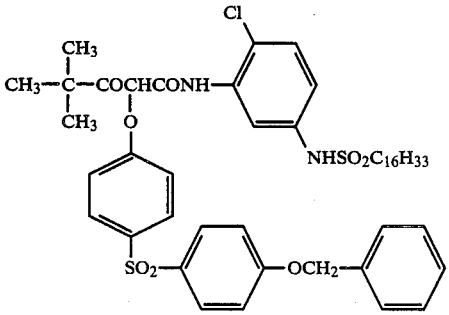

-continued
(Y-6)
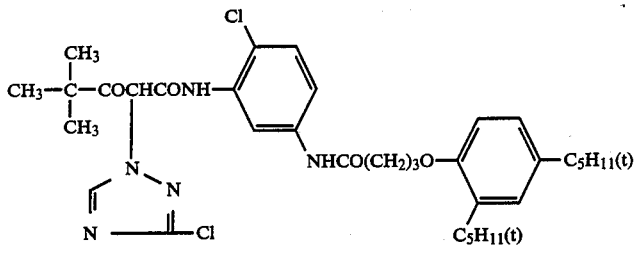
(Y-7)
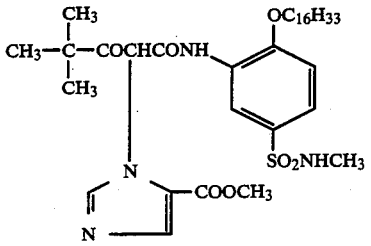
(Y-8)
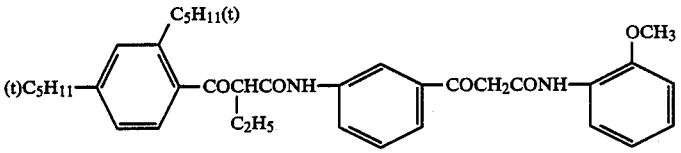
(Y-9)
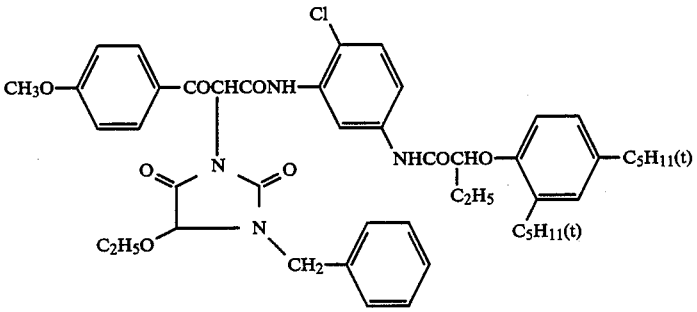
(Y-10)
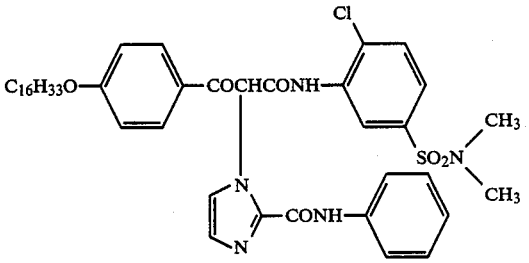
(Y-11)
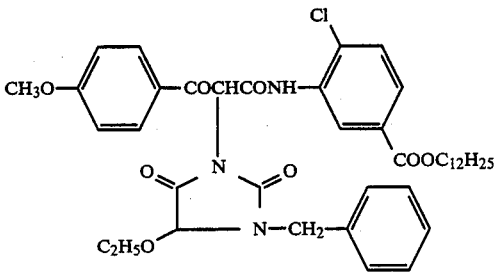

-continued
(M-1)
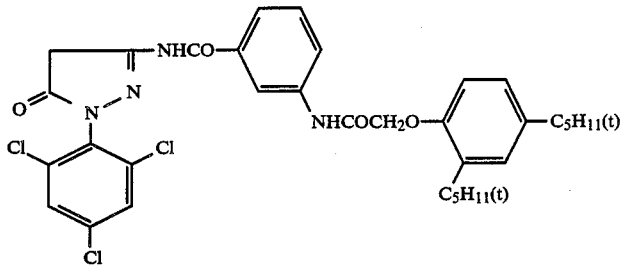
(M-2)
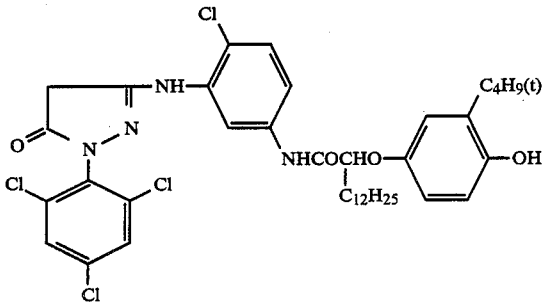
(M-3)
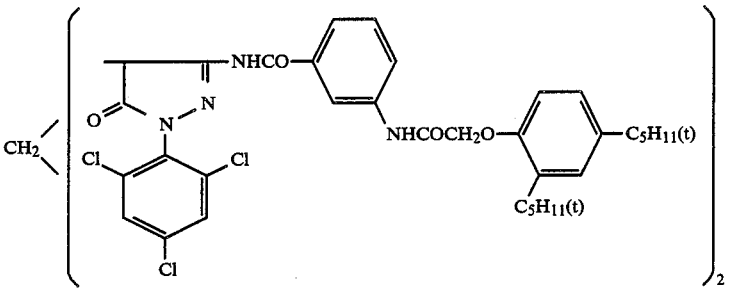
(M-4)
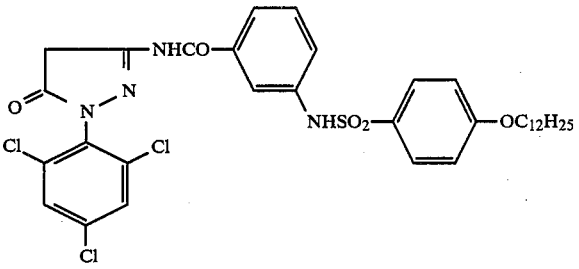
(M-5)
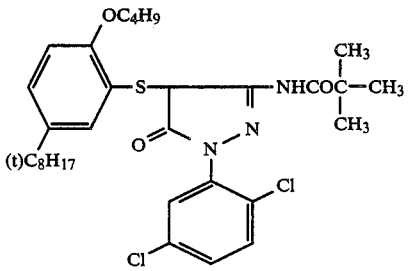

-continued
(M-6)
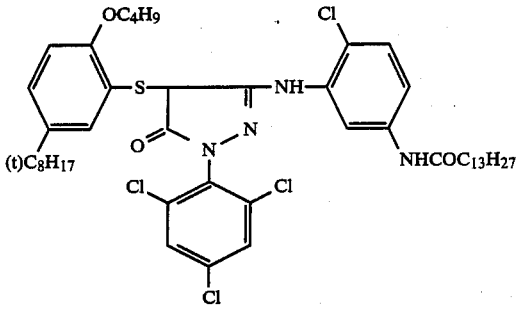
(M-7)
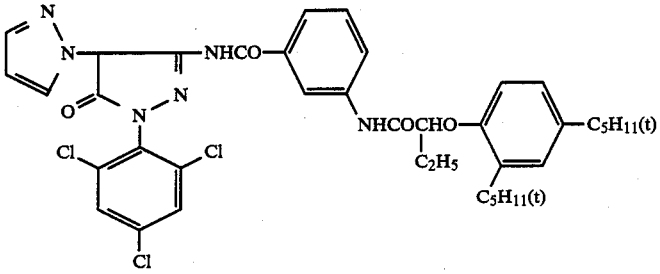
(M-8)
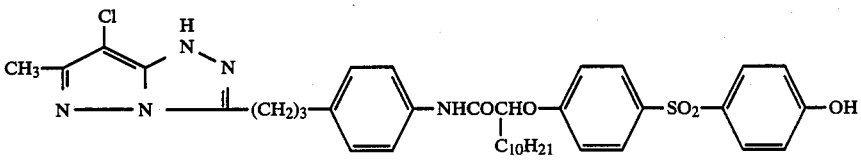
(M-9)
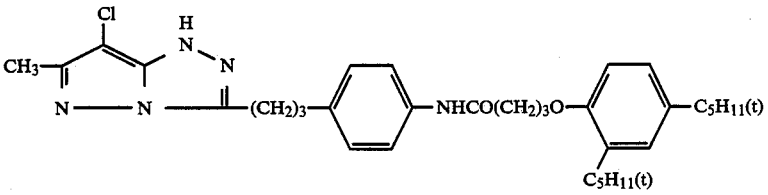
(M-10)
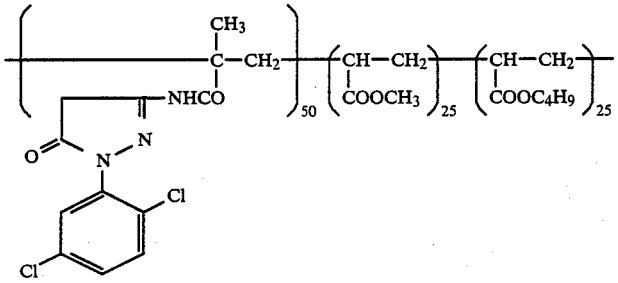
(C-1)
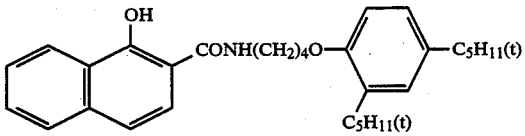
(C-2)
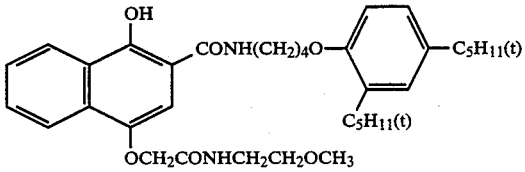

-continued (C-3)

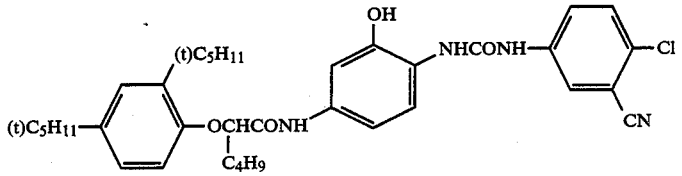

(C-4)

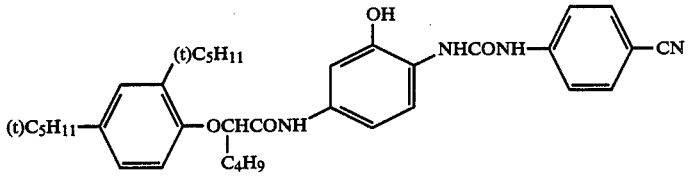

(C-5)

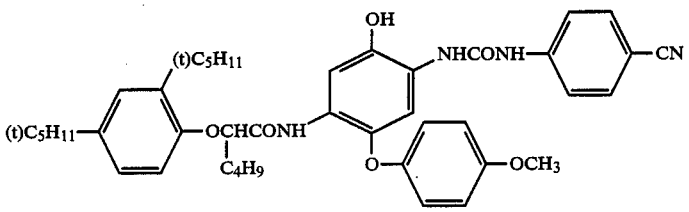

(C-6)

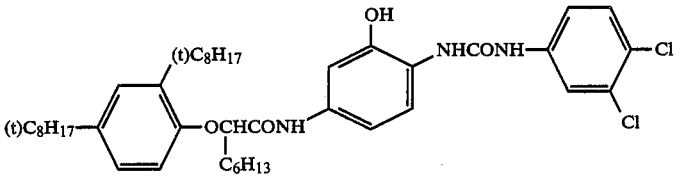

(C-7)

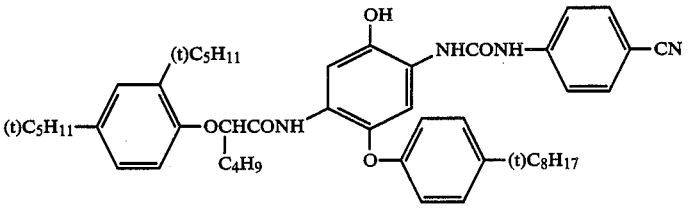

(C-8)

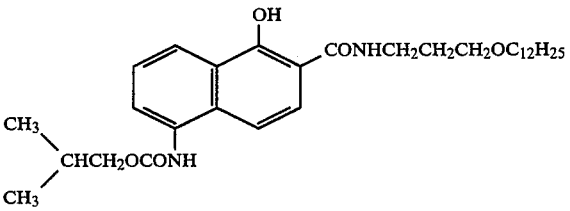

(C-9)

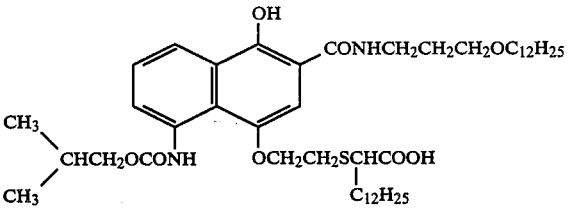

To incorporate the cyan coupler of the invention as well as the respective couplers according to the invention into a silver halide light-sensitive material, a conventionally known method may be observed. In one of known methods, the cyan coupler of the invention or the respective couplers according to the invention is dissolved in a mixture solution containing a known high-boiling solvent, and a low-boiling solvent such as butyl acetate and butyl propionate, thereby the resultant solution is blended with aqueous gelatin solution containing a surfactant. Next, the blended solution is subjected to emulsification with a high-speed mixer, colloid mill, or ultrasonic dispersion apparatus, whereby the dispersion is added to silver halide, in order to prepare a silver halide emulsion used in embodying the invention.

The useful high-boiling solvents are those conventionally known in the art; for exampole, those represented by the following general formula [XV], [XVI], [XVII], [XVIII], or [XIX].

General formula [XV]

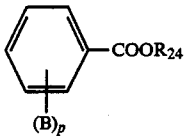

(wherein B represents a halogen atom, or an alkoxy group having 1 to 20 carbon atoms, or —$COOR_{24}$; $R_{24}$, an alkyl or phenyl group having 1 to 20 carbon atoms; p, an integer from 0 to 3; when p is 2 or 3, those represented by p may be identical or different with each other.)

General formula [XVI]

$$O{=}P(-OR_{25})_3$$

(wherein $R_{25}$ is synonymous with $R_{24}$ in thepreviously mentioned general formula [XV].)

General formula [XVII]

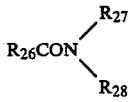

(wherein $R_{26}$ and $R_{27}$ independently represent an alkyl or phenyl group having 1 to 20 carbon atoms; $R_{28}$, a hydrogen atom, an alkyl or phenyl group having 1 to 20 carbon atoms; $R_{27}$ and $R_{28}$ may form a five- or six-membered ring together with a group of non-metal atoms.)

General formula [XVIII]

$$R_{29}COOR_{25}$$

(wherein $R_{29}$ represents an alkyl group having 1 to 20 carbon atoms; $R_{25}$ is synonymous with $R_{25}$ in the previously defined general formula [XVI].)

General formula [XIX]

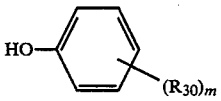

(wherein $R_{30}$ represents an alkyl group having 1 to 20 carbon atoms; m, an integer from 1 to 3; when m is 2 or three, those represented by $R_{30}$ may be identical with or different from each other.)

The typical examples of high-boiling solvents represented by general formulas [XV], [XVI], [XVII], [XVIII] and [XIX] are the following compounds. However, the scope of the invention is not limited only to these examples. These high-boiling solvents are arbitrarily selected in compliance with sa requirement, and two or more couplers of a specific dye may be combinedly used.

(HBS-1)

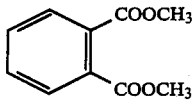

(HBS-2)

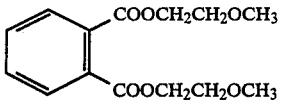

(HBS-3)

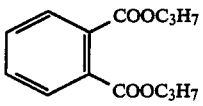

(HBS-4)

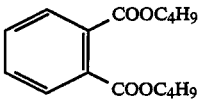

(HBS-5)

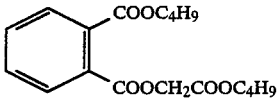

(HBS-6)

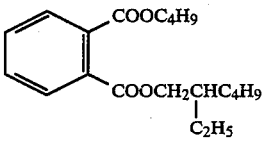

(HBS-7)

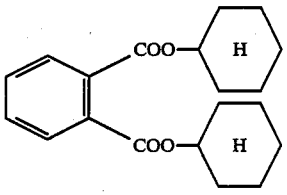

(HBS-8)

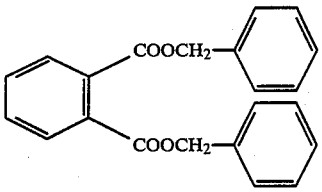

(HBS-9)

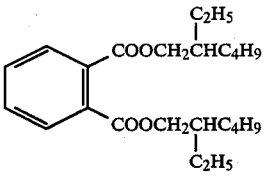

(HBS-10)

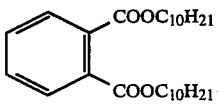

(HBS-11)

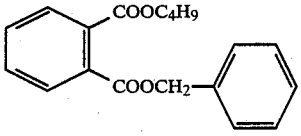

-continued
(HBS-12)
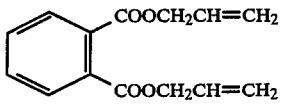
(HBS-13)
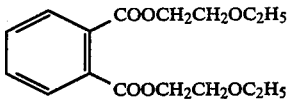
(HBS-14)
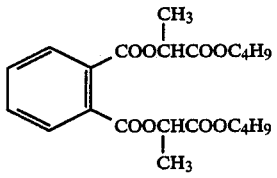
(HBS-15)
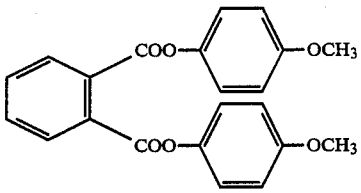
(HBS-16)
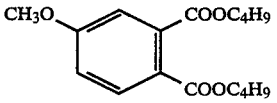
(HBS-17)
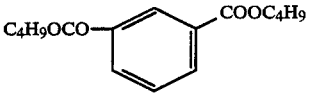
(HBS-18)
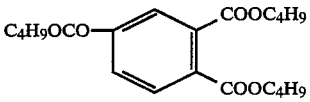
(HBS-19)
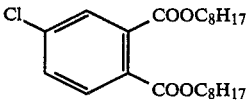
(HBS-20)
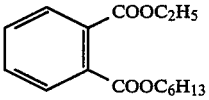
(HBS-21)
$O{=}P(-OC_4H_9)_3$
(HBS-22)
$O{=}P\left(-OCH_2CH(CH_3)C_4H_9\right)_3$
(HBS-23)
$O{=}P\left(-OCH_2CH_2CH(CH_3)-CH_2\right)_3$
(HBS-24)
$O{=}P(-OC_6H_{13})_3$
-continued
(HBS-25)
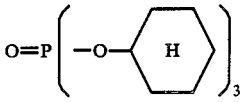
(HBS-26)
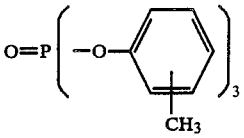
(HBS-27)
$O{=}P\left(-OCH_2CH(C_2H_5)C_4H_9\right)_3$
(HBS-28)
$O{=}P\left(-OC(CH_3)_2-CH_2C(CH_3)_2-CH_3\right)_3$
(HBS-29)
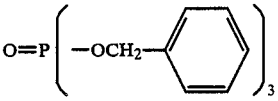
(HBS-30)
$O{=}P(OC_4H_9)(-OCH_2CH(C_2H_5)C_4H_9)_2$
(HBS-31)
$O{=}P\left(-OCH_2CH_2CH(CH_3)CH_2C(CH_3)_2-CH_3\right)_3$
(HBS-32)
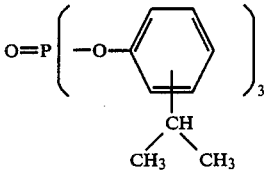
(HBS-33)
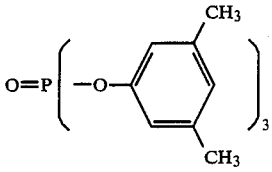
(HBS-34)
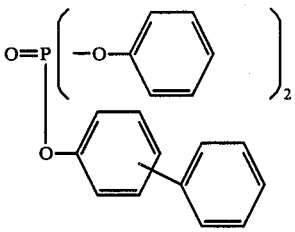
(HBS-35)
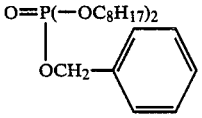

-continued (HBS-36)

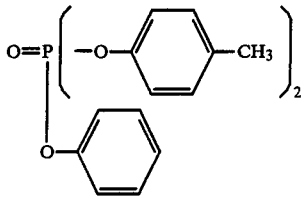

(HBS-37)

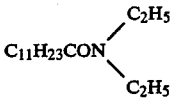

(HBS-38)

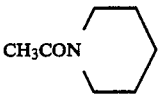

(HBS-39)

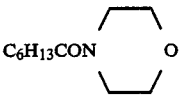

(HBS-40)

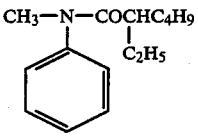

(HBS-41)

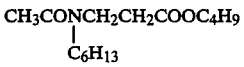

(HBS-42)

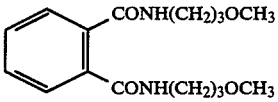

(HBS-43)

(HBS-44)

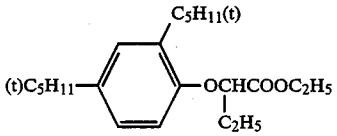

(HBS-45)

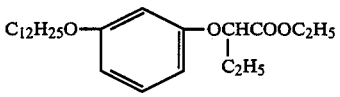

(HBS-46)

(HBS-47)

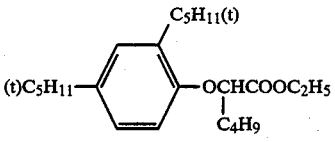

(HBS-48)

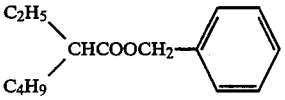

(HBS-49)

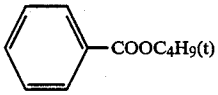

-continued (HBS-50)

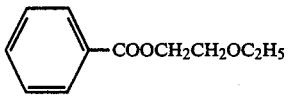

(HBS-51)

(HBS-52)

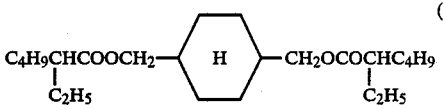

(HBS-53)

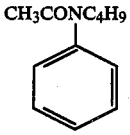

(HBS-54)

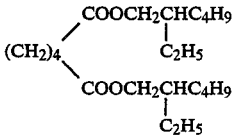

(HBS-55)

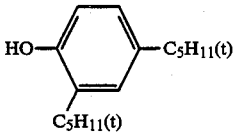

(HBS-56)

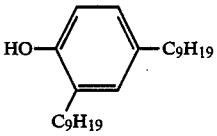

(HBS-57)

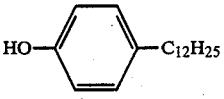

(HBS-58)

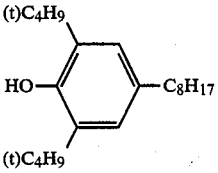

(HBS-59)

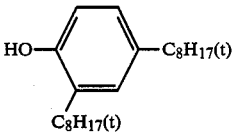

(HBS-60)

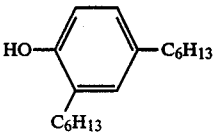

A silver halide color photographic light-sensitive material prepared according to the invention may, in compliance with a specific requirement, incorporate a colored coupler for color correction, a DIR (development inhibitor releasing) coupler, a non-colored coupler for improving hues of the material, or various additives conventionally used, such as an ultraviolet absorber, and an agent for stable photographic performance.

The useful colored couplers include a colored magenta coupler, and a colored cyan coupler; these couplers are represented by the following general formulas [XX] and [XXI].

General formula [XX]

$$M-N=N-Ar$$

(wherein M represents a residue group formed by removing one hydrogen atom from an active site on a magenta coupler; Ar, an aryl group.)

General formula [XXI]

$$C-(J)_q-N=N-Ar$$

(wherein C represents a residue group formed by removing a hydrogen atom from an active site on a phenol class or naphthol class cyan coupler; J, a bivalent bonding group; Ar, an aryl group; and q, 0 or 1, respectively.)

A preferred example of M in general formula [XX] is a magenta coupler represented by general formula [X] or [XI] above ($R_{14}$ represents a substituted phenyl group). A preferred example of C in general formula [XXI] is a cyan coupler represented by general formula [XII] above. A preferred example of q is 1.

Colored magenta couplers and colored cyan couplers respectively represented by general formulas [XX] and [XXI] include the following compounds. However, the scope of the invention is not limited only to these examples. More than two of the respective type of colored couplers may be combinedly used.

(CM-1)

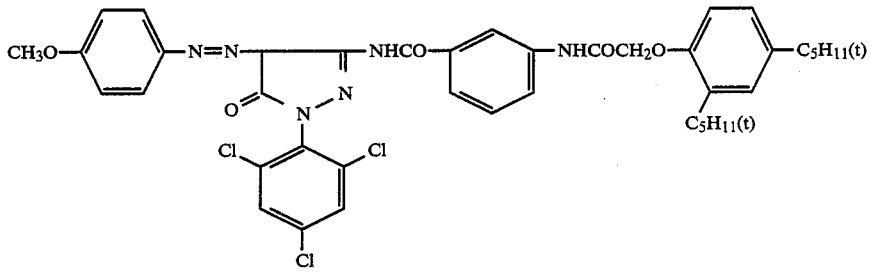

(CM-2)

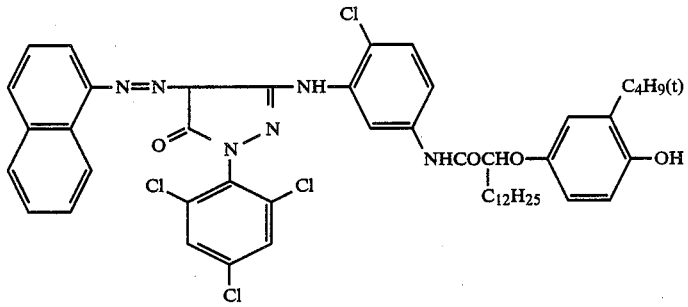

(CM-3)

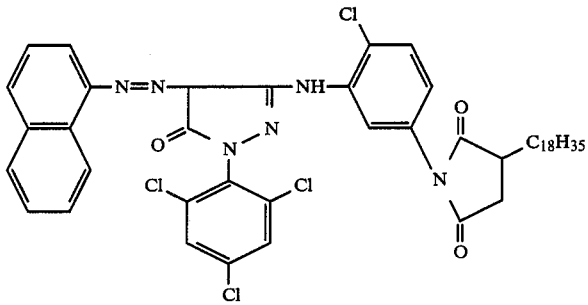

(CM-4)

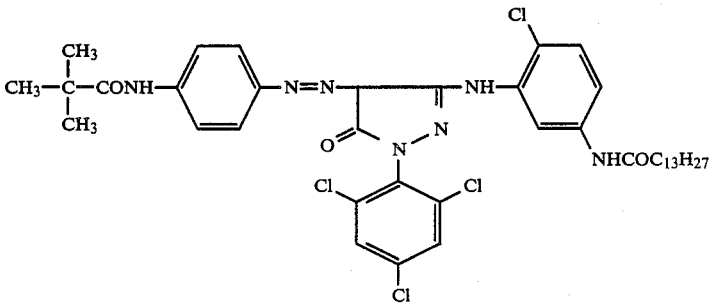

-continued
(CM-5)
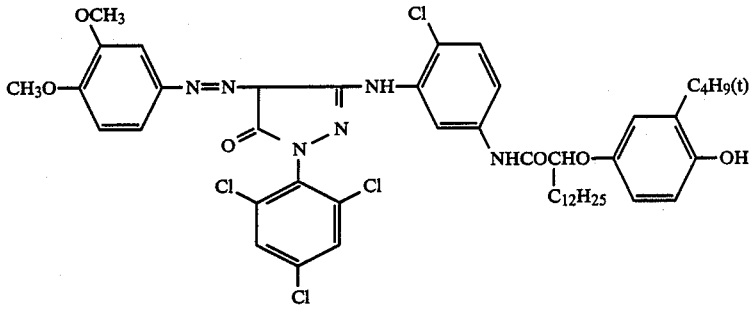
(CM-6)
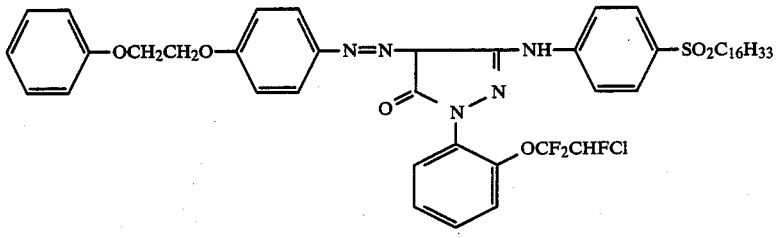
(CM-7)
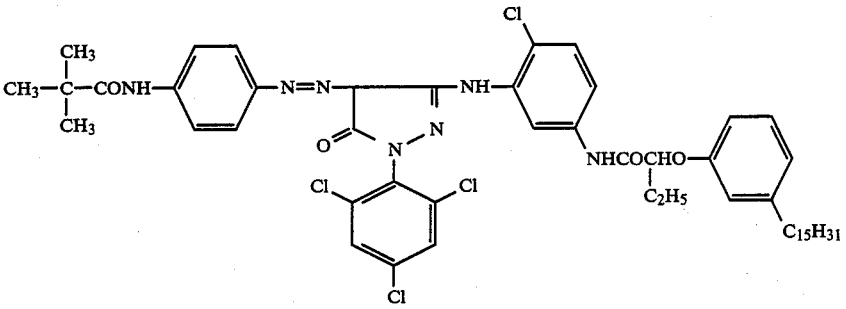
(CC-1)
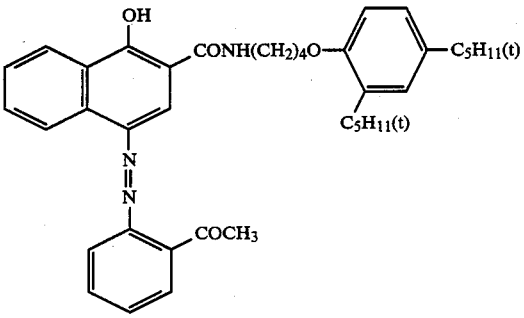
(CC-2)
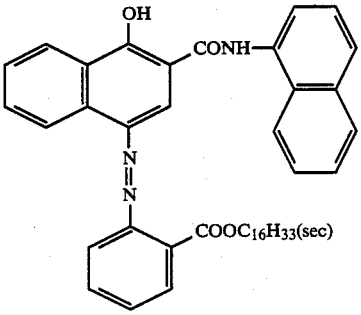

-continued (CC-3)

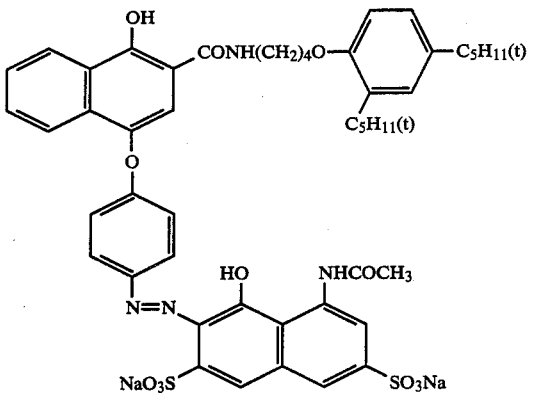

(CC-4)

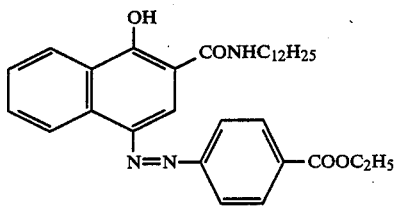

(CC-5)

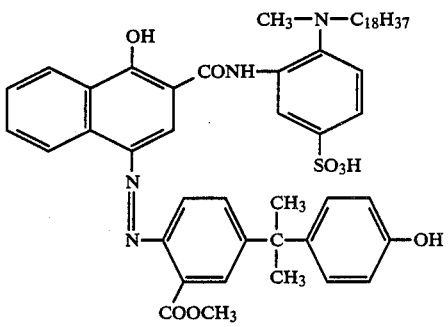

(CC-6)

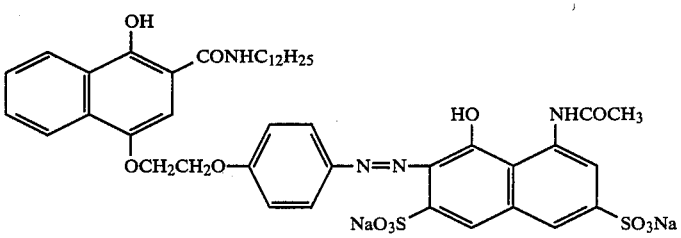

The useful DIR couplers are represented by the following general formula [XXII].

General formula [XXII]

$$C_p \leftarrow J' \rightarrow_q I$$

(wherein $C_p$ represents a residue group having a site which is capable of coupling to an oxidation product of a color developing agent, and one hydrogen atom removed from the site; J' represents a bivalent group which is capable of being released from $C_p$ by reaction with an oxidation product of a color developing agent and releasing I by, for example, intramolecular nucleophilic substitution reaction, or electron transfer, or hydrolysis; I represents a development inhibitor and q is 0 or 1.)

The typical preferred DIR couplers are listed below. However, the scope of the invention is not limited only to these examples. A relevant DIR coupler is selected in compliance with a specific requirement. More than two couplers may be combinedly used if necessary.

(D-1)
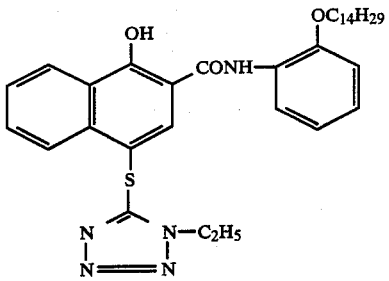
(D-2)
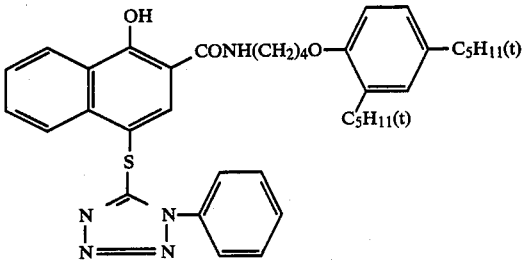
(D-3)
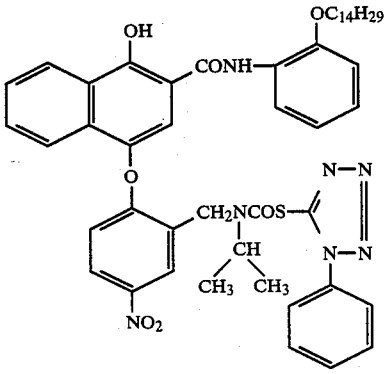
(D-4)
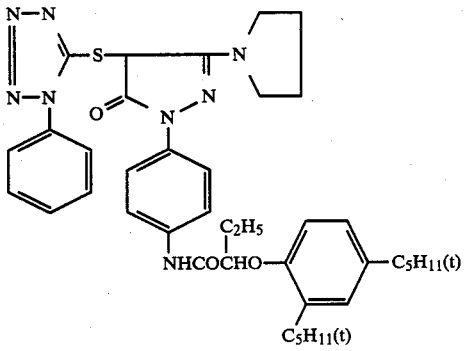

-continued
(D-5)
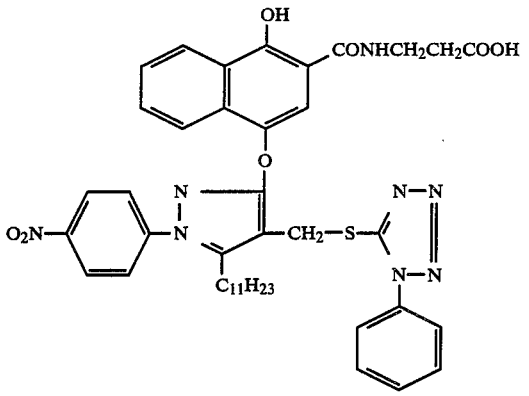
(D-6)
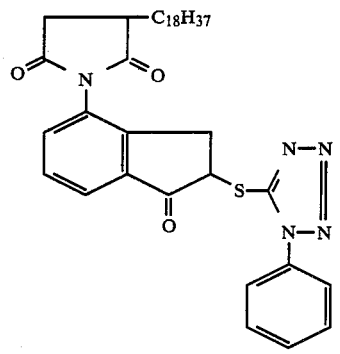
(D-7)
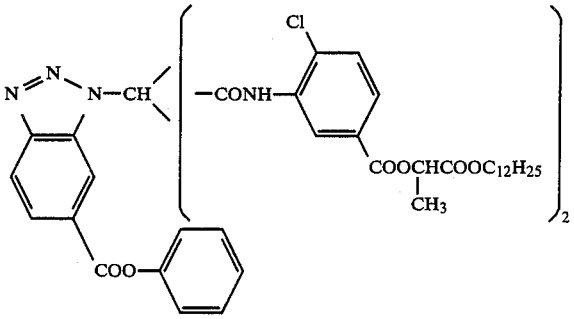
(D-8)
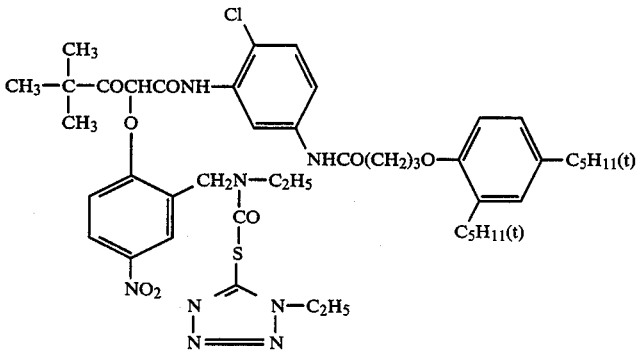

-continued
(D-9)
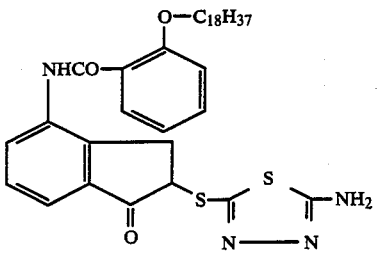
(D-10)
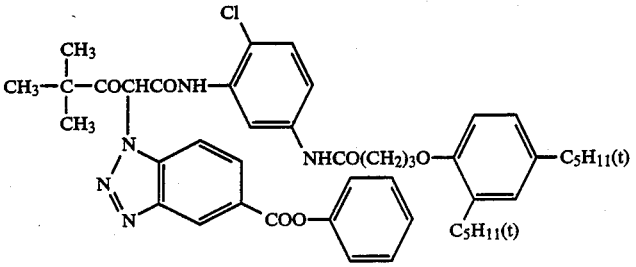
(D-11)
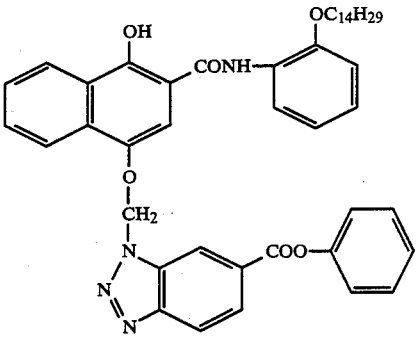
(D-12)
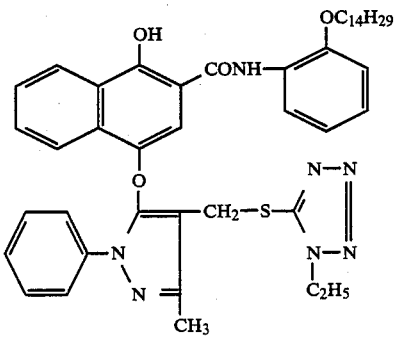
(D-13)
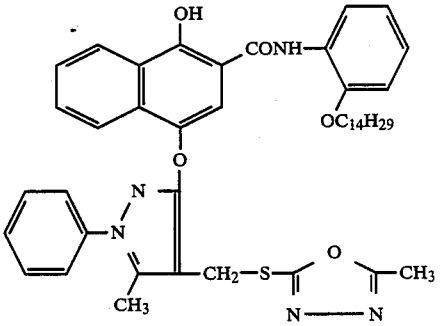
The useful ultraviolet absorbers are those represented by the following general formulas [XXIII] and [XXIV].

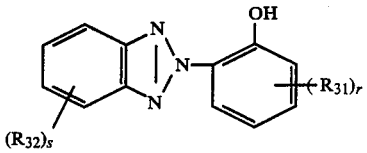

(wherein $R_{31}$ represents an alkyl group having 1 to 20 carbon atoms; $R_{32}$, a halogen atom; r, and integer 1 or 2; and s, an integer 0 or 1, when r is 2, those represented by $R_{31}$ may be identical with or different from each other.)

General formula [XXIV]

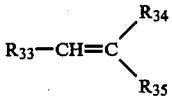

(wherein $R_{33}$ represents an aryl group, or vinyl group; $R_{34}$ and $R_{35}$ independently represent a cyano group, alkoxycarbonyl group, or arylsulfonyl group.)

The typical examples of a useful ultraviolet absorber are listed below. However, the scope of the invention is not limited only to these examples. More than two of the examples may be combinedly used if necessary.

(U-1)

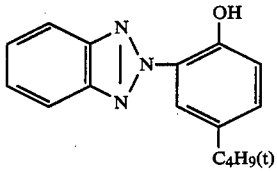

(U-2)

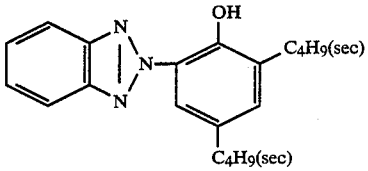

(U-3)

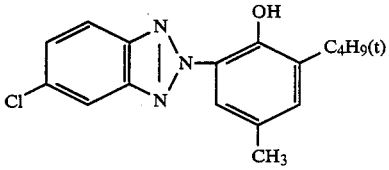

(U-4)

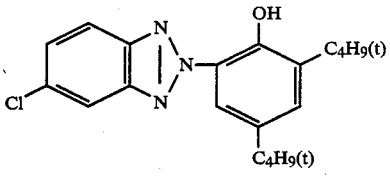

(U-5)

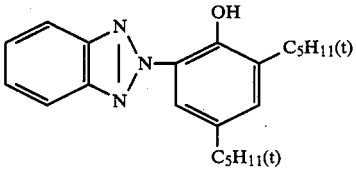

-continued (U-6)

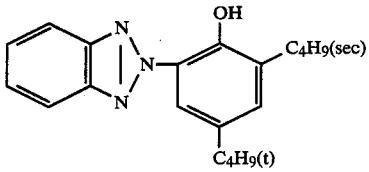

(U-7)

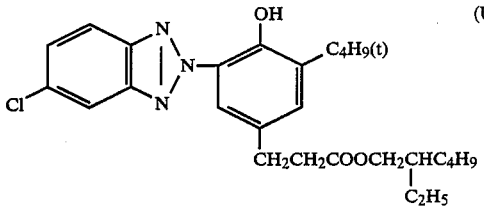

(U-8)

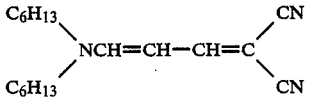

(U-9)

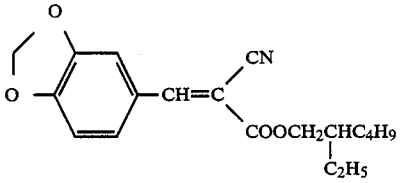

(U-10)

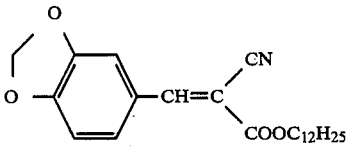

(U-11)

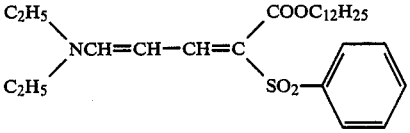

(U-12)

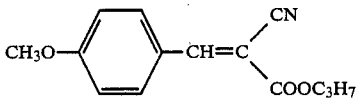

(U-13)

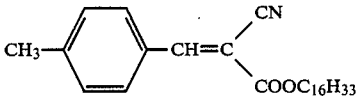

(U-14)

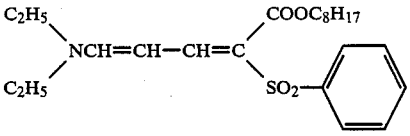

(U-15)

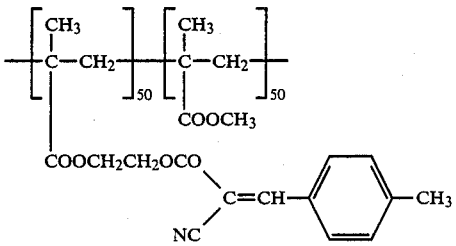

-continued

The useful stabilizing agents include an anti-fogging agent, and a dye image stabilizer, and represented by the following general formulas [XXV], [XXVI] and [XXVII].

General formula [XXV]

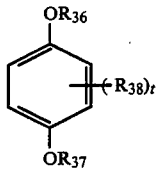

(wherein $R_{36}$ and $R_{37}$ independently represent a hydrogen atom, or an alkyl group having 1 to 20 carbon atoms; $R_{38}$, an alkyl or sulfone group having 1 to 20 carbon atoms; t, an integer 1 or 2; when t is 2, those represented by $R_{38}$ may be identical or different with each other; $R_{37}$ and $R_{38}$ may form a five- or six-membered ring together with a group of non-metal atoms.)

General formula [XXVI]

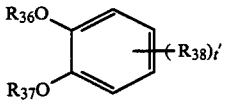

(wherein $R_{36}$, $R_{37}$ and $R_{38}$ are synonymous with $R_{36}$, $R_{37}$ and $R_{38}$ in the previously specified general formula [XXV]; t', an integer 1 or 2; when t' is 2, those represented by may be identical or different with each other; $R_{38}$ may form a five- or six-membered ring at the ortho position.)

General formula [XXVII]

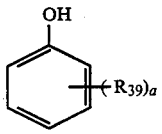

(wherein $R_{39}$ represents an alkyl group, phenoxycarbonyl group, benzenesulfonamide group or alkylsulfonamide group; a, integer 1 to 3; when a is 2 or 3, those represented by $R_{39}$ may be identical or different with each other.)

The examples of stabilizers represented by general formulas [XXV], [XXVI] and [XXVII] are listed below. However, the scope of the invention is not limited only to these examples. More than two types of stabilizers may be used combinedly in compliance with a specific requirement.

(A-1)

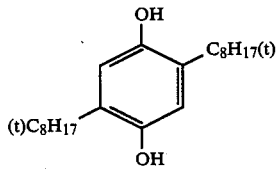

-continued (A-2)

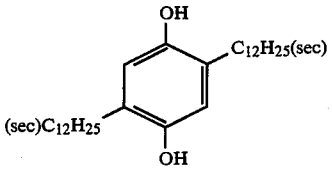

(A-3)

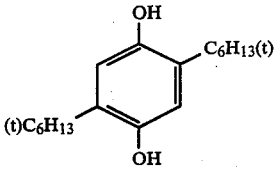

(A-4)

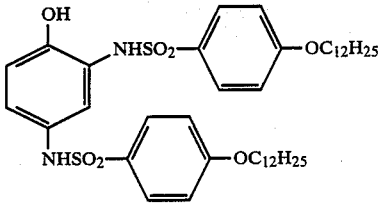

(A-5)

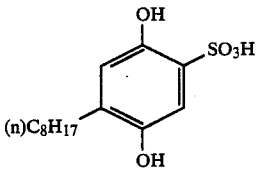

(A-6)

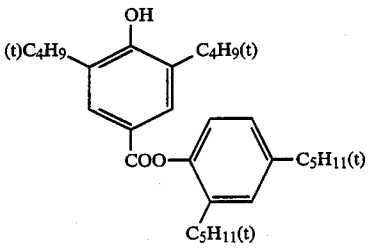

(A-7)

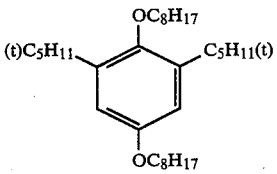

(A-8)

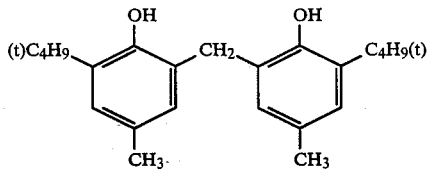

(A-9)

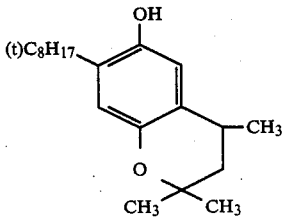

-continued (A-10)

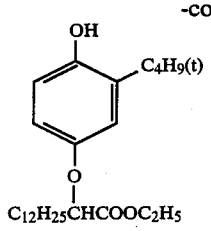

(A-11)

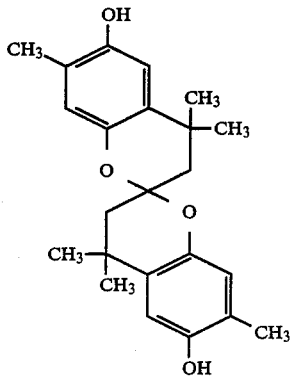

(A-12)

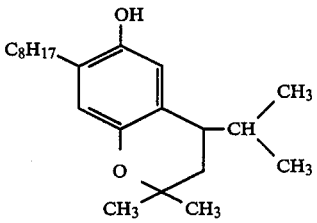

(A-13)

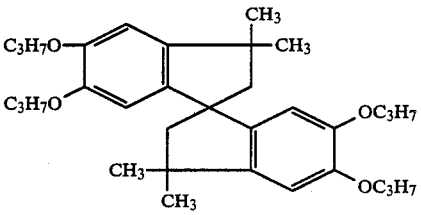

When incorporating the cyan coupler of the invention as well as the respective couplers according to the invention, a rate of addition is usually approximately 0.005 to 2, or, preferably, 0.01 to 0.5 mol per mol silver halide.

The type of silver halide incorporated into the silver halide emulsion used in embodying the invention is arbitrarily selected from those used in a conventional silver halide emulsion, for example, silver bromide, silver chloride, silver iodo-bromide, silver chloro-bromide, and silver chloro-iodo-bromide.

The silver halide emulsion for composing a silver halide emulsion layer of the invention may be prepared using any of diverse methods including a conventional method. Such methods are as follows: a method, which is the method for preparing the so-called conversion emulsion, described in Japanese Patent Publication No. 7772/1971 wherein an emulsion of silver salt particles, a part of which is comprised of a silver salt having a solubility of greater than that of silver bromide, is prepared, thereby at least a portion of these silver salt particles are converted into silver bromide or silver iodo-bromide; and a method for preparing a Lippmann emulsion comprising fine particle silver halide with an average particle size of less than 0.1 μm. Additionally, the silver halide emulsion of the invention may be chemically sensitized by using certain compounds singly or combinedly. The examples of such compounds are as follows: sulfur sensitizers such as arylthiocarbamide, thiourea, and cystine; active or inactive selenium sensitizers; reduction sensitizers such as stannous salt, and polyamine; noble metal sensitizers such as potassium aurithiocyanate, potassium chloroaurate, and 2-aurosulfobenzthiazole methylchloride; water soluble salt sensitizers of ruthenium, rhodium, and iridium, and, more specifically, ammonium chloropalladate, potassium chloroplatinate, and sedium chloropalladite.

A silver halide emulsion used in embodying the invention may have various known photographic additives. Such additives are described, for example, in Research Disclosure Dec. 1978, No. 17643.

Silver halide used in embodying the invention is spectrally sensitized using an appropriate sensitizing dye in order to provide the silver halide with sensitivity in a required spectral band. Various spectral sensitizing dyes are singly or combinedly used for this purpose.

The typical spectral sensitizing dyes advantageously used in the invention are cyanine dyes, merocyanine dyes, and complex cyanine dyes described in U.S. Pat. Nos. 2,269,234, 2,270,378, 2,442,710, 2,454,620 and 2,776,280.

The support according to the invention is selected, in compliance with a specific requirement for the photographic light-sensitive material, from those known in the art, for example, a plastic film, plastic-laminated paper, baryta paper, and synthetic paper. These supports are usually subjected to subbing process in order to enhance adhesion between a support and a photographic emulsion layer.

The prepared silver halide color photographic light-sensitive material of the invention is, once exposed, subjected to various photographic processes for color developing. The preferred color developer used in the invention is one comprising an aromatic primary amine color developing agent as a principal component. The typical examples of such a color developing agent are p-phenylenediamine color developing agents, for example, diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-β-hydroxylethylamino)-toluene, 2-amino-5-(N-ethyl-β-methanesulfonamideethyl)aminotoluene sulfate, 2-amino-5-N-ethyl-N-β-methanesulfonamideethylamino) toluene, 4-(N-ethyl-N-β-hydroxyethylamino)aniline, and 2-amino-5-(N-ethyl-β-methoxyethyl)aminotoluene. The especially preferred color developing agent is selected from 2-amino-5-(N-ethyl-N-β-hydroxyethylamino)toluene, and 2-amino-5-(N-ethyl-N-β-methanesulfonamideethylamino)-toluene. These color developing agents are singly used or two or more of them may be combinedly used. Additionally, these agents are used, in compliance with a specific requirement, together with a black-and-white developing agent, such as hydroquinone. Furthermore, the color developer usually contains an alkali agent such as sodium hydroxide, ammonium hydroxide, sodium sulfite, and may further contain various additives such as alkali metal halide like potassium bromide, and a development control agent like citrazinic acid.

The silver halide color photogrphic light-sensitive material of the invention may contain, in a hydrophilic colloid layer, the previously mentioned color developing agent in the form of either the color developing agent itself or a precursor thereof. A precursor of color developing agent is a compound being capable of forming a color developing agent in the presence of an alkali. The examples of such a precursor include a Schiff base type precursor of an aromatic aldehyde derivative, multi-valent metal-ion complex precursor, phthalic imido derivative precursor, phosphoric amide derivatives precursor, sugar-amine reaction product precursor, and urethane precursor. These precursors of aromatic primary amine color developing agent are described in, for example, U.S. Pat. Nos. 3,342,599, 2,507,114, 2,695,234 and 3,719,492, British Patent No. 803,783, Japanese Patent O.P.I. Publication Nos. 135628/1978 and 79035/1979, Research Disclosure Nos. 15,159, 12,146 and 13,924.

These aromatic primary amine color developing agents or precursors thereof should be added in an amount to ensure satisfactory coloration in color developing. The amount greatly differs depending on a type of light-sensitive material. However, the usual amount is 0.1 to 5 mol, or, preferably, 0.5 to 3 mol per mol light-sensitive silver halide. These color developing agents or the precursors thereof may be used singly or combinedly. Incorporating such compounds into a photographic light-sensitive material is effected by dissolving such compounds in an arbitary solvent such as water, methanol, ethanol, and acetone. Otherwise, such compounds may be incorporated in the form of emulsification comprising a high-boiling organic solvent such as dibutyl phthalate, dioctyl phthalate, or tricresyl phosphate; or the compounds may be incorporated after being absorbed in a latex polymer as described in Research Disclosure No. 14850.

After color developing, the silver halide color photographic light-sensitive material is usually subjected to various processing steps such as bleaching and fixing, or bleach-fixing, and then washing with water. Various compounds are used as a bleacher. The typical examples of bleacher are multivalent metal compounds of iron (III), cobalt (III), and tin (II), in particular, complex salts of such multivalent metal cation and organic acid. Such complex salts include metal complex salts of aminopolycarboxylic acids such as ethylenediamine tetraacetic acid, nitrilo triacetic acid, and N-hydroxyethylenediamine diacetic acid; metal complex salts of malonic acid, tartaric acid, malic acid, diglycolic acid, and dithioglycolic acid; and ferricianates, and bichromates.

EXAMPLES

The present invention is hereinunder described in detail by referring to the preferred examples. However, the scope of the effective embodiment of the invention is not limited only to these examples.

EXAMPLE 1

As listed in Table 1, each amount of the cyan coupler of the invention was weighed at a rate of 0.1 mol per 1 mol silver, and added to dibutyl phthalate, serving as a high-boiling solvent, of which weight equivalent to that of the coupler, as well as to ethyl acetate of which weight three times as much as the cyan coupler, whereby each mixture was heated to 60° C. to solve the coupler completely. Additionally, to prepare comparative sample, each amount of a respective known comparative coupler was weighed at a rate of 0.1 mol per 1 mol silver, and added to dibutyl phthalate of which weight equivalent to that of the coupler, as well as to ethyl acetate of which weight three times as much as the cyan coupler, whereby each mixture was heated to 60° C. to solve the coupler completely. Each of these solutions was mixed with 1200 ml of 5% aqueous gelatin soluton comprising 120 ml of 5% aqueous solution of Alkanol B (alkylnaphthalene sulfonate, manufactured by DuPont), thereby the mixture was homogenized with an ultrasonic homogenized, thus each emulsification product was prepared. Then, each of this dispersion was added to 4 kg of red-sensitive silver iodo-bromide emulsion (containing 7 mol% silver iodide), to which 120 ml of 2% aqueous solution of 1,2-bis(vinylsulfonyl) ethane (water:methanol=1:1) serving as a hardener was added, thereby the emulsion was applied onto and dried over a transparent polyester base having a subbing layer, and thus each sample having a stable coating layer was prepared (amount of coated silver was 15 mg/100 $cm^2$).

Each of samples thus prepared was subjected to wedge exposing in compliance with a conventional method, and treated in the following developing process. The results are listed in Table 1.

The sensitivity and maximum color density of each sample were determined with Model PDA-65 photographic densitometer manufactured by Konica Corporation.

| [Processing] (38° C.) | Processing time |
|---|---|
| Color developing | 3 min. 15 sec. |
| Bleaching | 1 min. 30 sec. |
| Washing | 3 min. 15 sec. |
| Fixing | 6 min. 30 sec. |
| Washing | 3 min. 15 sec. |
| Stabilizing | 1 min. 30 sec. |

The compositions of the respective processing solutions are as follows.

| [Color developer composition] | |
|---|---|
| 4-amino-3-methyl-N—ethyl-N—(β-hydroxylethyl)-aniline sulfate | 4.75 g |
| Sodium sulfite anhydride | 4.25 g |
| Hydroxyamino ½ sulfate | 2.0 g |
| Potassium carbonate anhydride | 37.0 g |
| Sodium bromide | 1.3 g |
| Trisodium nitrilotriacetate, monohydride | 2.5 g |
| Potassium hydroxide | 1.0 g |

Water was added to the ingredients to prepare one liter solution, of which pH was adjusted to 10.0 with potassium hydroxide.

| [Bleacher composition] | |
|---|---|
| Ferric ammonium ethylenediaminetetraacetate | 100.0 g |
| Diammonium ethylenediaminetetraacete | 10.0 g |
| Ammonium bromide | 150.0 g |
| Glacial acetic acid | 10.0 ml |

Water was added to the ingredients to prepare one liter solution, of which pH was adjusted to 6.0 with aqueous ammonium solution.

| [Fixer composition] | |
|---|---|
| Ammonium thiosulfate (50% aqueous solution) | 162 ml |

-continued

| [Fixer composition] | |
|---|---|
| Sodium sulfite anhydride | 12.4 g |

Water was added to the ingredients to prepare one liter solution, of which pH was adjusted to 6.5 with acetic acid.

| [Stabilizer] | |
|---|---|
| Formalin (37% aqueous solution) | 5.0 ml |
| Konidax (Konica Coporation) | 7.0 ml |

Water was added to the ingredients to prepare one liter solution.

TABLE 1

| Sample No. | Coupler No. | Relative sensitivity | Maximum color density | Maximum absorption wavelength | Δλs |
|---|---|---|---|---|---|
| 1 | C-2 | 100 | 2.98 | 696 | 123 |
| 2 | Comparative coupler (A) | 97 | 2.75 | 692 | 127 |
| 3 | Comparative coupler (B) | 95 | 2.60 | 691 | 128 |
| 4 | Comparative coupler (C) | 89 | 2.73 | 690 | 128 |
| 5 | Comparative coupler (D) | 85 | 2.52 | 690 | 129 |
| 6 | Comparative coupler (E) | 89 | 2.61 | 689 | 130 |
| 7 | (1) | 130 | 3.30 | 693 | 128 |
| 8 | (2) | 127 | 3.21 | 692 | 127 |
| 9 | (9) | 110 | 3.17 | 690 | 127 |
| 10 | (11) | 108 | 3.02 | 691 | 126 |
| 11 | (13) | 112 | 3.15 | 691 | 125 |
| 12 | (20) | 131 | 3.40 | 694 | 128 |
| 13 | (22) | 129 | 3.38 | 693 | 127 |
| 14 | (23) | 125 | 3.30 | 690 | 126 |
| 15 | (25) | 127 | 3.32 | 692 | 127 |
| 16 | (26) | 120 | 3.19 | 694 | 127 |
| 17 | (29) | 135 | 3.50 | 693 | 128 |
| 18 | (30) | 120 | 3.20 | 695 | 127 |
| 19 | (32) | 138 | 3.55 | 695 | 128 |
| 20 | (34) | 118 | 3.10 | 691 | 126 |
| 21 | (36) | 132 | 3.35 | 692 | 126 |

In the table above, the respective relative sensitivity values are based on the sensitivity of Sample No. 1 i.e. 100. The maximum absorption wavelength values ($\lambda_{max}$) are wavelengths respectively giving density of 1.0, while $\Delta\lambda_s$ indicates values respectively obtained by subtracting, from $\lambda_{max}$, an absorption wavelength in a short-wave side corresponding with 20% of the spectral absorption property obtainable from the density 1.0.

Comparative coupler (A)

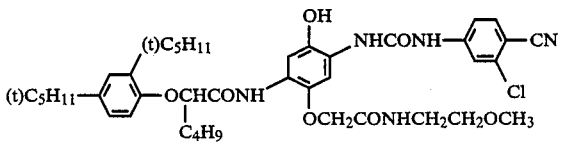

(Compound described in Japanese Patent O.P.I. Publication No. 72245/1986)

Comparative coupler (B)

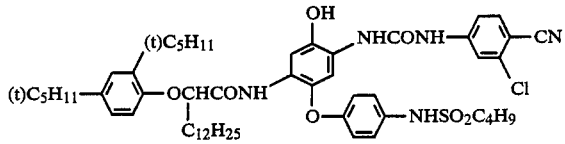

(Compound described in Japanese Patent O.P.I. Publication No. 72245/1986)

Comparative coupler (C)

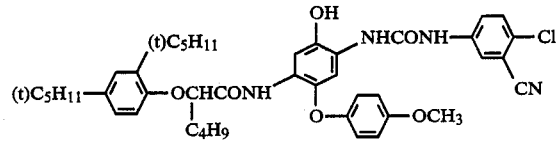

(Compound described in Japanese Patent O.P.I. Publication No. 72245/1986)

Comparative coupler (D)

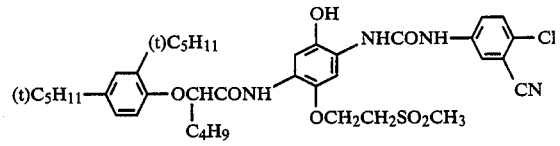

(Compound described in Japanese Patent O.P.I. Publication No. 72245/1986)

Comparative coupler (E)

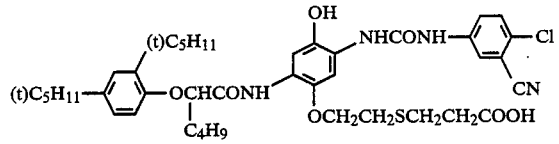

(Compound described in Japanese Patent O.P.I Publication No. 72245/1986)

Table 1 shows that the comparative couplers are inferior to coupler C-2 both in terms of sensitivity and maximum color density, and that, when compared to coupler C-2 as well as the comparative couplers, each of coupler sample Nos. 7 through 21 according to the invention has remarkably high sensitivity as well as high maximum color density.

EXAMPLE 2

The respective samples prepared in Example 1 were subjected to wedge exposing, and then, to color developing in Example. Each sample was treated with bleach-fixer having the following compositions, whereby the fading of cyan dye due to fatigued bleach-fixer was examined.

| [Bleach-fixer composition] | |
|---|---|
| Ferric ammonium ethylenediaminetetraacetate | 50 g |
| Ammonium sulfite (40% solution) | 50 ml |
| Ammonium thiosulfate (70% solution) | 140 ml |
| Ammonium water (28% solution) | 20 ml |
| Ethylenediaminetetraacetic acid | 4 g |
| Hydrosulfite | 5 g |

Water was added to the ingredients to prepare one liter solution.

Each of the obtained samples were examined for maximum color density. Table 2 lists the results. The dye residue percent at maximum density was determined by the following expression.

$$\text{Dye residue percent} = \frac{\text{Processing concentration of fatigued bleach-fixer}}{\text{Processing concentration of fresh bleach-fixer}} \times 100$$

TABLE 2

| Sample No. | Coupler No. | Concentration of fresh bleach-fixer | Concentration of fatigued bleach-fixer | Dye residue percent (%) |
|---|---|---|---|---|
| 22 | C - 2 | 2.98 | 2.24 | 75 |
| 23 | Comparative coupler (A) | 2.75 | 2.53 | 94 |
| 24 | Comparative coupler (B) | 2.60 | 2.32 | 95 |
| 25 | Comparative coupler (C) | 2.73 | 2.64 | 96 |
| 26 | Comparative coupler (D) | 2.52 | 2.30 | 96 |
| 27 | Comparative coupler (E) | 2.61 | 2.47 | 95 |
| 28 | (1) | 3.30 | 3.17 | 96 |
| 29 | (2) | 3.21 | 3.05 | 95 |
| 30 | (9) | 3.17 | 3.02 | 95 |
| 31 | (11) | 3.02 | 2.90 | 96 |
| 32 | (13) | 3.15 | 3.06 | 97 |
| 33 | (20) | 3.40 | 3.25 | 96 |
| 34 | (22) | 3.38 | 3.24 | 96 |
| 35 | (23) | 3.30 | 3.18 | 96 |
| 36 | (25) | 3.32 | 3.17 | 95 |
| 37 | (26) | 3.19 | 3.10 | 97 |
| 38 | (29) | 3.50 | 3.40 | 97 |
| 39 | (30) | 3.20 | 3.00 | 94 |
| 40 | (32) | 3.55 | 3.32 | 94 |
| 41 | (34) | 3.10 | 2.98 | 96 |
| 42 | (36) | 3.35 | 3.21 | 96 |

Table 2 shows that the sample having a naphthol coupler (C-1) indicates greatly faded cyan dye when treated with a fatigued bleach-fixer. In contrast, it is apparent from the table that the samples (Nos. 28 through 42) using a coupler of the invention show less faded cyan dye, as comparable to the samples using comparative couplers (A) through (E).

EXAMPLE 3

Upon a treatment polyester base having a subbing layer, the following layers were disposed, in the following order, in order to prepare each of the samples respectively having the constitution specified in Table 3.

First layer (anti-halation layer)

Aqueous gelatin solution containing black colloidal silver was applied at a rate of 0.5 g/m$^2$ in terms of amount of silver in order to form a layer with a dry thickness of 3.0$\mu$.

Second layer (intermediate layer)

Aqueous gelatin solution was applied in order to form a layer with a dry thickness of 1.0$\mu$. Third layer (red-sensitive low-sensitivity silver halide emulsion layer)

First, a red-sensitive low-sensitivity silver halide emulsion was prepared in the following manner: an iodo-bromide emulsion (a mixture comprising, at a ratio of 2:1, an iodo-bromide emulsion having an average particle size of 0.6$\mu$ with 4 mol% of silver iodide and an iodo-bromide emulsion having an average particle size of 0.3$\mu$ with 4 mol% of silver iodide) was chemically sensitized using a gold-sensitizer and sulfur-sensitizer, to which were added, as red-sensitive sensitizing dyes, 9-ethyl-3,3'di-(3-sulfopropyl)-4,5,4',5'-dibenzothiacarbo-cyanine hydroxide anhydride, 5,5'-dichloro-9-ethyl-3,3'-di-(3-sulfobutyl)thiacarbocyanine hydroxide anhydride, and 2-[2-{(5-chloro-3-ethyl-2(3H)-benzothiazolydene)methyl}-1-butenyl-5-chloro-3-(4-sulfobutyl)]-benzoxazolium; thereby added were 1.0 g of 4-hydroxy-6-methyl-1,3,3a,7-tetraazaindene and 20.0 mg of 1-phenyl-5-mercaptotetraazole.

Next, a cyan coupler, DIR compound, colored cyan coupler, anti-fogging agent and high-boiling solvent were added to 150 ml of ethyl acetate, and then, dissolved by heating, thereby the solution was added to 550 ml of 7.5% aqueous gelatin solution containing 5 g of sodium triisopropylnaphthalenesulfonate, and the mixture was homogenized using a colloid mill. The resultant dispersion was heated to remove ethyl acetate, thereby to the dispersion was added the red-sensitive low-sensitivity emulsion mentioned above. The resultant emulsion was applied in order to form a layer with a dry thickness of 4.0 $\mu$m (100 g gelatin contained per mol silver halide.)

Fourth layer (red-sensitive high-sensitivity silver halide emulsion layer)

First, a red-sensitive low-sensitivity silver halide emulsion was prepared in the following manner; an iodo-bromide emulsion (an average particle size of 1.2$\mu$ with 7 mol% of silver) was chemically sensitized using a gold-sensitizer and sulfur-sensitizer, to which were added, as red-sensitive sensitizing dyes, 9-ethyl-3,3'-di-(3-sulfopropyl)-4,5,4',5'-dibenzothiacarbocyanine hydroxide anhydride, 3,3'-dichloro-9-ethyl-3,3'-di-(3-sulfobutyl)thiacarbocyanine hydroxide anhydride, and 2-[2-{(5-chloro-3-ethyl-2(3H)-benzothiazolydene)methyl}-1-butenyl-5-chloro-2-(4-sulfobutyl)benzoxazolium anhydride; thereby added were 1.0 g of 4-hydroxy-6-methyl-1,3,3a,7-tetraazaindene and 10.0 mg of 1-phenyl-5-mercaptotetraazole.

Next, a cyan coupler, DIR compound, anti-fogging agent and high-boiling solvent were added to 60 ml of ethyl acetate, and then, dissolved by heating, thereby the solution was added to 30 ml of 7.5% aqueous solution containing 1.5 g of sodium triisopropylnaphthalenesulfonate, and the mixture was homogenized using a colloid mill. To the resultant dispersion was added the red-sensitive high-sensitivity emulsion mentioned above. The resultant emulsion was applied in order to form a layer with a dry thickness of 2.0 $\mu$m (100 g gelatin contained per mol silver halide).

Fifth layer (intermediate layer)

Identical with the second layer. Sixth layer (green-sensitive low-sensitivity silver halide emulsion layer)

First, a green-sensitive low-sensitivity silver halide emulsion was prepared in the following manner: an iodo-bromide emulsion having an average particle size of 0.6 $\mu$m with 4 mol% of silver iodide and an iodo-bromide emulsion having an average particle size of 0.3 $\mu$m with 7 mol% of silver iodide were independently chemically sensitized using a gold-sensitizer and sulfur-sensitizer, thereby to the respective emulsions were added, as green-sensitive sensitizing dyes, 5,5'-dichloro-9-ethyl-3,3'-di-(3-sulfobutyl)oxacarbocyanine hydroxide anhydride, and 3,3-diphenyl-9-ethyl-3,3'-di-(3-sulfobutyl)oxacarbocyanine hydroxide anhydride, and 9-ethyl-3,3'- di-(3-sulfopropyl)-5,6,5',6'-dibenzoxycarnocyanine hydroxide anhydride; thereby added were 1.0 g of 4-hydroxy-6-methyl-1,3,3a,7-tetraazaindene and 20.0 mg of 1-phenyl-5-mercaptotetrazole; then, the two types of silver halide emulsions prepared were mixed together at a ratio of 1:1.

Next, a magenta coupler, DIR coupler, colored magenta coupler, anti-fogging agent and high-boiling solvent were added to 240 ml of ethyl acetate, and then, dissolved by heating, thereby the solution was added to 7.5% aqueous gelatin solution containing sodium triisopropylnaphthalenesulfonate, and the mixture was homogenized using a colloid mill. To the resultant dispersion was added the green-sensitive low-sensitivity emulsion mentioned above. The resultant emulsion was applied in order to form a layer with a dry thickness of 4.0 μm (100 g gelation contained per mol silver halide).

Seventh layer (green-sensitive high-sensitivity silver halide emulsion layer)

First, a green-sensitive high-sensitivity silver halide emulsion was prepared in the following manner: an iodo-bromide emulsion (having an average particle size of 1.2μ with 7mol% of silver iodide) was chemically sensitized using a gold-sensitizer and sulfur-sensitizer, to which were added, as green-sensitive sensitizing dyes, 5,5'-dichloro-9-ethyl-3,3'-di-(3-sulfobutyl)oxacarbocyanine hydroxide anhydride, and 5,5'-diphenyl-9-ethyl-3,3'-di-(3-sulfobutyl)oxacarbocyanine hydroxide anhydride, and 9-ethyl-3,3'-di-(3-sulfopropyl)-5,6,5'6'-benzoxacarbocyanine hydroxide anhydride; thereby added were 1.0 g of 4-hydroxy-6-methyl-1,3,3a,7-tetraazaindene and 10.0 mg of 1-phenyl-5-mercaptotetraazole.

Next, a magenta coupler, DIR coupler, colored magenta coupler, anti-fogging agent and high-boiling solvent were added to 200 ml of ethyl acetate, and then, dissolved by heating, thereby the solution was added to 7.5% aqueous gelatin solution containing sodium triisopropylnaphthalenesulfonate, and the mixture was homogenized using a colloid mill. To the resultant dispersion was added the green-sensitive high-sensitivity emulsion mentioned above. The resultant emulsion was applied in order to form a layer with a dry thickness of 2.0 μm (100 g gelatin contained per mol silver halide).

Eighth layer (intermediate layer)

Identical with the second layer.

Ninth layer (yellow filter layer)

To an aqueous gelatin solution having dispersed yellow colloidal silver were added a solution prepared by dissolving 3 g of 2,3-di-t-octylhydroquinone and 1.5 g of di-2-ethylhexyphthalate in 10 ml of ethyl acetate, as well as a dispersion prepared by dissolving 0.3 g of sodium triisopropylnaphthalenesulfonate, thereby the resultant emulsion was applied so that a dry thickness was 1.2 μ containing gelatin at a rate of 0.9 g/m$^2$, and 2,5-di-t-octylhydroquinone at a rate of 0.10 g/m$^2$.

Tenth layer (Blue-sensitive low-sensitivity silver halide emulsion layer)

An iodo-bromide emulsion having an average particle size of 0.6 μm with 6 mol% of silver iodide was chemically sensitized using a gold-sensitizer and sulfur-sensitizer, thereby to the emulsions was added, as sensitizing dyes, 5,5'-dimethoxy 3,3'-di-(3-sulfopropyl)-thiacyanine hydroxide anhydride, and then 1.0 g of 4-hydroxy-6-methyl-2,3,3a,7-tetraazaindene and 20.0 mg of 1-phenyl-5-mercaptotetraazole. Then the mixture was treated with a conventional technique, and a blue-sensitive low-sensitivity silver halide emulsion was prepared.

Next, a yellow coupler, and high-boiling solvent were added to 300 ml of ethyl acetate, and then, dissolvent by heating, thereby the solution was added to 7.5% aqueous gelatin solution containing sodium triisopropylnaphthalenesulfonate, and the mixture was homogenized using a colloid mill. To the resultant dispersion was added the blue-sensitive low-sensitivity emulsion mentioned above. The resultant emulsion was applied in order to form a layer with a dry thickness of 4.0 μm (240 g gelatin contained per mol silver halide).

Eleventh layer (blue-sensitive high-sensitivity silver halide emulsion layer)

An iodo-bromide emulsion (an average particle size of 1.2μ with 7 mol% of silver iodide was chemically sensitized using a gold-sensitizer and sulfur-sensitizer, thereby to the emulsion were added, as sensitizing dyes, 5,5'-dimethoxy-3,3'-di-(3-sulfopropyl)thiacyanine hydroxide anhydride, and then 1.0 g of 4-hydroxy-6-methyl-1,3,3a,7-tetraazaindene and 10.0 mg of 1-phenyl-5-mercaptotetraazole. Then the mixture was treated with a conventional technique, and a blue-sensitive high-sensitivity silver halide emulsion was prepared.

Next, a yellow coupler, and high-boiling solvent were added to 240 ml of ethyl acetate, and then, dissolved by heating, thereby the solution was added to 7.5% aqueous gelatin solution containing sodium triisopropylnaphthalenesulfonate, and the mixture was homogenized using a colloid mill. To the resultant dispersion was added the blue-sensitive high-sensitivity emulsion mentioned above. The resultant emulsion was applied in order to form a layer with a dry thickness of 2.0 μm (160 g gelatin contained per mol silver halide).

Twelfth layer (intermediate layer)

To 2 ml of ethyl acetate were added a high-boiling solvent and ultraviolet absorbent, thereby the solution was added to 7.5% aqueous gelatin solution containing sodium triisopropylnaphthalene sulfonate, and the mixture was homogenized with a colloid mill. The resultant emulsion was applied in order to form a layer with a dry thickness of 1.0 μm and rate of gelatin applied was 1.0 g/m$^2$.

Thirteenth layer (protective layer)

An aqueous gelatin solution containing 4 g gelatin per 100 ml and 0.2 g of 1,2-bisvinylsulfonylethane per 100 ml was applied so that amount of gelatin applied was at a rate of 1.3 g/m$^2$ and a dry thickness was 1.2 μm.

TABLE 3

| | Sample No. 43 | | | | | |
|---|---|---|---|---|---|---|
| | Coupler No. Amount applied | High-boiling solvent Amount applied | DIR coupler Amount applied | Colored coupler Amount applied | Anti-fogging agent Amount applied | Ultra-violet absorbent Amount applied |
| 13th layer (protective layer) | | | | | | |
| 12th layer (intermediate layer) | | HBS-9 2 | | | | U-5 2 |
| 11th layer (blue-sensitive high-sensitivity layer) | Y-3 11 | HBS-9 50 | | | | |
| 10th layer (blue-sensitive low-sensitivity layer) | Y-3 34 | HBS-9 50 | | | | |
| 9th layer (yellow filter layer) | | | | | | |
| 8th layer (intermediate layer) | | | | | | |
| 7th layer (green-sensitive high-sensitivity layer) | M-3 1.0 | HBS-26 100 | D-5 0.04 | CM-3 0.3 | A-1 1.8 | |
| 6th layer (green-sensitive high-sensitivity layer) | M-1 7.9 | HBS-26 100 | D-6 0.4 | CM-3 0.8 | A-1 0.5 | |
| 5th layer (intermediate layer) | | HBS-9 0.06 | | | A-1 0.06 | |
| 4th layer (red-sensitive high-sensitivity layer) | (1) 1.8 | HBS-9 100 | D-13 0.4 | | A-1 0.5 | |
| 3rd layer (red-sensitive low-sensitivity layer) | C-3 10.0 | HBS-9 100 | D-2 0.4 | CC-3 0.3 | A-1 0.5 | |
| 2nd layer (intermediate layer) | | | | | | |
| 1st layer (anti-halation layer) | | | | | | |
| Support | | | | | | |

In Table 3, the amounts applied indicate amounts per mol silver halide, whereby the amounts of coupler, DIR coupler and colored coupler are in mol%, the amounts of high-boiling solvent and ultraviolet absorbent are in weights per $m^2$. The amount (g per $m^2$) of high-boiling solvent was equal to that of ultraviolet absorbent. Additionally, the amount (g per $m^2$) of anti-fogging agent in the fifth layer is in weight (g) per $m^2$; and the amount by weight of high-boiling solvent used is the same as anti-fogging agent.

Each sample prepared with a constitution specified in Table 3 was treated with the processing steps in Example 1. As a result, each sample was found to be a silver halide color photographic light-sensitive material having satisfactory color balance.

In contrast to a conventional technique, the present invention, by using a cyan coupler represented by general formula [I], provides a cyan dye image with high sensitivity and high color density free from dye loss even treated with a fatigued bleaching bath or bleach-fixing bath.

This photographic light-sensitive material also excels in spectral property and is capable of providing a cyan coupler with excellent dispersion stability.

What is claimed is:

1. A silver halide color photographic light-sensitive material comprising a silver halide emulsion layer containing a cyan coupler represented by the following formula (I):

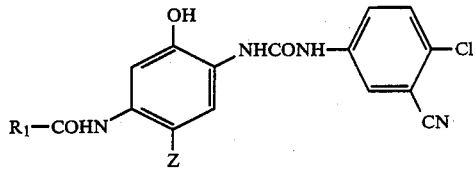

(I)

wherein $R_1$ is a substituted or unsubstituted alkyl or a substituted or unsubstituted aryl group, and Z is a group represented by the following formulas (II), (III), (IV) or (V):

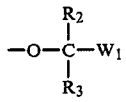

(II)

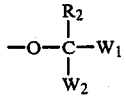

(III)

$$-OCOR_4 \quad \text{(IV)}$$

$$-OSO_2R_5 \quad \text{(V)}$$

wherein $R_2$, $R_3$ and $R_5$ independently denote a hydrogen atom, a substituted or unsubstituted alkyl group, or substituted or unsubstituted aryl group, $R_2$ and $R_3$ may be the same or different from each other; $W_1$ represents a trifluoromethyl group, a cyano group, or a substituted or unsubstituted group of formyl, acyl, alkoxycarbonyl, aryloxycarbonyl, sulfonyl, and a sulfamoyl group, $W_2$ represents a halogen atom, a trifluoromethyl group, a cyano group, or a substituted or unsubstituted group of carbamoyl, formyl, acyl, alkoxycarbonyl, aryloxycarbonyl, sulfonyl and sulfamoyl, $W_1$ and $W_2$ may be the same or different from each other; $R_4$ represents an alkyl group, an aryl group, an alkoxy group, an aryloxy group, an alkylamino group or aryl amino group, which may be substituted or unsubstituted.

2. The silver halide color photographic light-sensitive material of claim 1, wherein said alkyl group of $R_1$ is an alkyl group having one to twenty carbon atoms, which may be substituted or unsubstituted.

3. The silver halide color photographic light-emulsion material of claim 2, said alkyl group is represented by the following formula (VI):

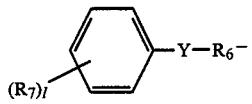

(VI)

wherein Y is an oxygen atom, a sulfur group or a —$SO_2$— group; $R_6$ represents a substituted or unsubstituted alkylene group having one to twenty carbon atoms and $R_7$ represents a halogen atom, a hydroxyl group, or a substituted or unsubstituted group of alkyl having one to twenty carbon atoms, alkoxy, alkylsulfonamido, arylsulfon-amido, alkylsulfamoyl, arylsulfamoyl, alkylsulfonyl, arylsulfonyl and alkoxycarbonyl; is an integer of from 1 to 4, provided that the $R_7$s may be the same or different from each other when is 2 or more.

4. The silver halide color photographic light-sensitive material of claim 1, wherein said aryl group represented by $R_1$ is a substituted or unsubstituted phenyl group.

5. The silver halide color photographic light-sensitive material of claim 1, said cyan coupler is contained in said silver halide emulsion layer in an amount of from 0.005 mol to 2 mol per mol of silver halide contained in said silver halide emulsion layer.

6. The silver halide color photographic light-sensitive material of claim 1, said cyan coupler is contained in said silver halide emulsion layer in an amount of from 0.01 mol to 0.5 mol per mol of silver halide contained in said silver halide emulsion layer.

* * * * *

UNITED STATES PATENT AND TRADEMARK OFFICE

CERTIFICATE OF CORRECTION

PATENT NO. : 4,865,961

DATED : September 12, 1989

INVENTOR(S) : NORIO MIURA et al.

It is certified that error appears in the above-identified patent and that said Letters Patent is hereby corrected as shown below:

Claim 3, column 63, lines 29-30, delete "emulsion" and substitute therefor --sensitive--; and Claim 3, column 64, line 16, delete "when is" and substitute therefor --when I is--.

Signed and Sealed this

Fifteenth Day of September, 1992

*Attest:*

*Attesting Officer*

DOUGLAS B. COMER

*Acting Commissioner of Patents and Trademarks*